US006145975A

United States Patent [19]

Kotaki et al.

[11] Patent Number: 6,145,975

[45] **Date of Patent: *Nov. 14, 2000**

[54] METHOD OF MOUNTING AN EXCHANGEABLE INK CONTAINER

[75] Inventors: Yasuo Kotaki, Machida; Masanori Takenouchi, Yokohama; Hideo Saikawa, Machida; Minoru Nozawa, Yokohama; Osamu Sato, Kawasaki; Toshihiko Ujita, Yamato; Masashi Miyagawa, Yokohama; Hisashi Yamamoto, Machida; Yuji Hamasaki, Sagamihara; Jun Hinami, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/708,636

[22] Filed: Sep. 5, 1996

Related U.S. Application Data

[62] Division of application No. 08/348,939, Nov. 25, 1994, Pat. No. 5,619,239.

[30] Foreign Application Priority Data

| | | | |
|---|---|---|---|
| Nov. 29, 1993 | [JP] | Japan | 5-298194 |
| Nov. 29, 1993 | [JP] | Japan | 5-298195 |
| Jul. 29, 1994 | [JP] | Japan | 6-178877 |
| Aug. 4, 1994 | [JP] | Japan | 6-183681 |

[51] Int. Cl.[7] ..... B41J 2/14; B41J 2/175

[52] U.S. Cl. ..... 347/87; 347/49

[58] Field of Search ..... 347/85, 86, 87, 347/49

[56] References Cited

U.S. PATENT DOCUMENTS

| | | | |
|---|---|---|---|
| 4,419,678 | 12/1983 | Kasugayama et al. . | |
| 4,578,685 | 3/1986 | Tanaka et al. | 346/139 R |
| 4,736,213 | 4/1988 | Piatt et al. . | |
| 4,771,295 | 9/1988 | Baker et al. . | |
| 4,872,026 | 10/1989 | Rasmussen et al. . | |
| 4,969,759 | 11/1990 | Suzuki et al. | 400/124 |
| 5,138,344 | 8/1992 | Ujita . | |
| 5,155,502 | 10/1992 | Kimura et al. . | |
| 5,156,470 | 10/1992 | Suzuki et al. | 400/124 |
| 5,156,471 | 10/1992 | Suzuki et al. | 400/124 |
| 5,156,472 | 10/1992 | Suzuki et al. | 400/124 |
| 5,156,473 | 10/1992 | Suzuki et al. | 400/124 |
| 5,158,377 | 10/1992 | Suzuki et al. | 400/124 |
| 5,174,665 | 12/1992 | Suzuki et al. | 400/124 |
| 5,208,610 | 5/1993 | Su et al. . | |
| 5,212,502 | 5/1993 | Bowling . | |
| 5,221,148 | 6/1993 | Suzuki et al. | 400/124 |
| 5,237,342 | 8/1993 | Saikawa et al. . | |
| 5,245,361 | 9/1993 | Kashimura et al. . | |
| 5,328,279 | 7/1994 | Suzuki et al. | 400/124 |
| 5,392,063 | 2/1995 | Rhoads | 347/49 |
| 5,421,658 | 6/1995 | Suzuki et al. | 400/124 |
| 5,448,274 | 9/1995 | Hirabayashi et al. | 347/86 |
| 5,500,664 | 3/1996 | Suzuki et al. | 347/86 |
| 5,515,091 | 5/1996 | Suzuki et al. | 400/124 |
| 5,619,239 | 4/1997 | Kotaki et al. | 347/86 |
| 5,642,143 | 6/1997 | Rhoads | 347/49 |
| 376719 | 7/1990 | European Pat. Off. . | |

FOREIGN PATENT DOCUMENTS

| | | |
|---|---|---|
| 31712 | 3/1996 | Australia . |
| 0139508 | 5/1985 | European Pat. Off. . |
| 261764 | 3/1988 | European Pat. Off. . |

(List continued on next page.)

*Primary Examiner*—N. Le
*Assistant Examiner*—Judy Nguyen
*Attorney, Agent, or Firm*—Fitzpatrick, Cella, Harper & Scinto

[57] ABSTRACT

A mounting method of an ink container to an ink jet unit mountable to an ink jet recording apparatus, wherein the ink container is mounted while a corner portion of the ink container between a top surface and a rear side is slid in contact with an urging member and while a corner portion of the ink container between a front side and a bottom side is slid toward a front side of the ink jet unit in contact with an inner bottom surface of the ink jet unit.

25 Claims, 18 Drawing Sheets

FOREIGN PATENT DOCUMENTS

| | | |
|---|---|---|
| 408241 | 1/1991 | European Pat. Off. . |
| 440261 | 8/1991 | European Pat. Off. . |
| 488829 | 6/1992 | European Pat. Off. . |
| 551752 | 7/1993 | European Pat. Off. . |
| 560729 | 9/1993 | European Pat. Off. . |
| 577439 | 1/1994 | European Pat. Off. . |
| 0622208 | 4/1994 | European Pat. Off. . |
| 676294 | 10/1994 | European Pat. Off. . |
| 622208 | 11/1994 | European Pat. Off. . |
| 9203206 | 7/1992 | Germany . |
| 9300132 | 6/1993 | Germany . |
| 9405723 | 7/1995 | Germany . |
| 59-198311 | 9/1984 | Japan . |
| 60-120064 | 6/1985 | Japan . |
| 60-192642 | 8/1985 | Japan . |
| 63-003958 | 1/1988 | Japan . |
| 63-015752 | 1/1988 | Japan . |
| 2039945 | 2/1990 | Japan . |
| 2-187366 | 7/1990 | Japan . |
| 4110157 | 4/1992 | Japan . |
| 5-057906 | 2/1993 | Japan . |
| 5-104735 | 4/1993 | Japan ..... 347/86 |
| 5-162298 | 6/1993 | Japan . |
| 5-162301 | 6/1993 | Japan . |
| 6-320830 | 12/1994 | Japan . |

101
103
106

101
104
105
105b
105a
114
115
109Y
107Y
108a
106Y
109C
107C
106

101
103
104
105
111
112
113
103
110
114
106

106M
106Y
102
201Y
201M
201C
201BK
201
106C
106BK 109c
109BK
108b
103
111
104
115
110
108a
109M
109Y
103

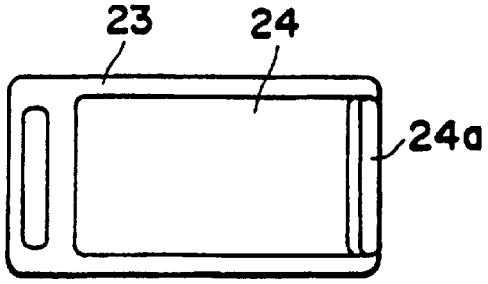
FIG. 2d
FIG. 2a
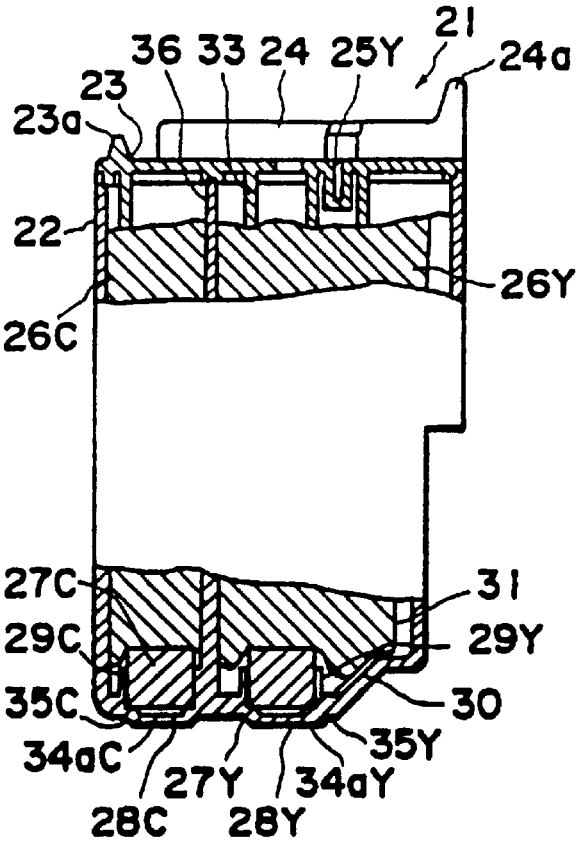
FIG. 2b
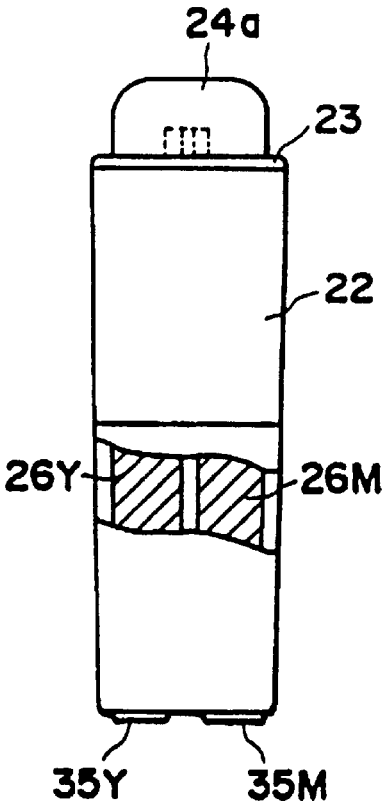
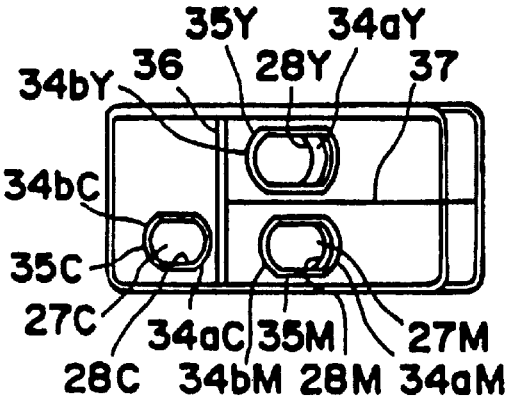
FIG. 2c

FIG. 14a
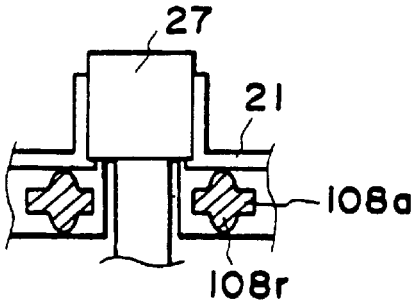
FIG. 14b
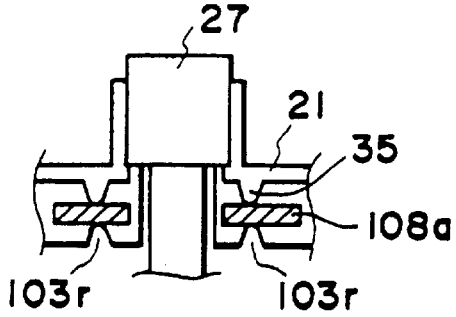
FIG. 14c
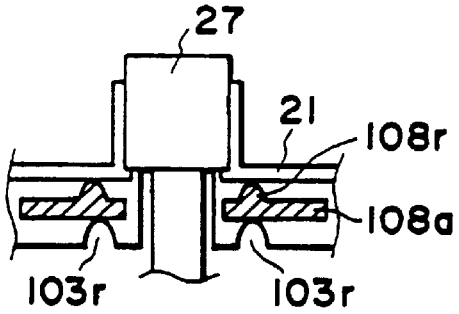
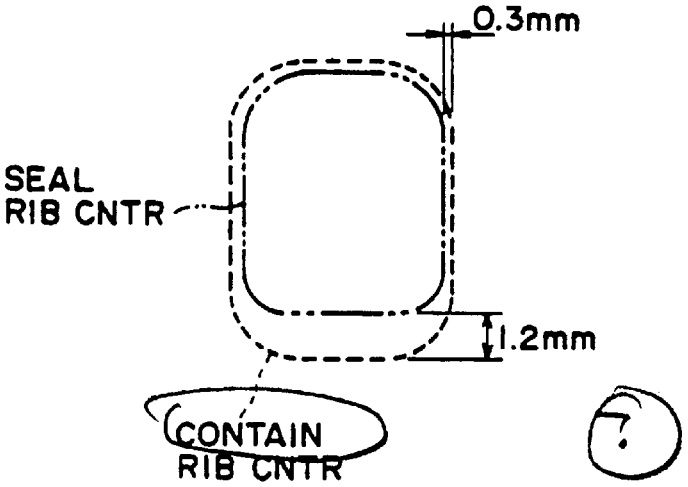
FIG. 15

METHOD OF MOUNTING AN EXCHANGEABLE INK CONTAINER

This application is a division of application Ser. No. 08/348,939 filed Nov. 25, 1994, now U.S. Pat. No. 5,319,239.

FIELD OF THE INVENTION AND RELATED ART

The present invention relates to an ink container to be installed in a color recording apparatus, a method for installing the ink container into the apparatus or removing it, and an apparatus in which the ink container can be installed. In particular, it relates to an exchangeable ink container that takes up less space, has a larger ink capacity, and can be reliably installed into a recording head cartridge; a method for installing the ink container into the apparatus or removing it; and an apparatus in which the ink container can be installed.

In the field of ink jet recording, in recent years, an ink jet unit in the form of a cartridge, in which a recording head and an ink container are integrated into a single unit, has come to be widely used in order to reduce the apparatus size, to accomplish a maintenance free operation, and, other reasons. This type of ink jet unit can be easily installed on, or removed from, a scanning carriage provided in the apparatus, and can be simply exchanged with a fresh one by a user when the ink within the ink container is depleted.

Also, in the ink jet recording field, demand for color recording has been growing rapidly. As for a structure that employs the ink jet unit described in the foregoing to satisfy the demand for color recording, there are employed for color printing, for example: a structure in which a plurality of ink jet units, each containing a different color ink, are aligned on the carriage in parallel with the scanning direction; a structure in which an integral color ink jet unit comprising color ink containers, each containing one of the yellow, magenta, or cyan color inks that are used for color printing and being aligned in parallel with the recording heads that eject these inks, respectively, and an ink jet unit dedicated to eject black ink, which are disposed on the carriage to effect color printing, as disclosed in U.S. Pat. No. 4,771,295; or the like structure.

The ink jet unit is discarded with the recording head when the ink within the ink container is depleted. However, the durability of the recording head is extremely long relative to the amount of the ink containable in the ink container. Therefore, discarding such an ink jet unit is not preferable from the viewpoint of natural resource preservation, environmental protection, or the like.

Therefore, a different structure has been proposed, such as the one disclosed in U.S. Pat. No. 44,419,678, in which the recording head and ink container of the ink jet unit are rendered separable from each other so that it is possible to discard only the depleted ink container and replace it with a fresh one.

During the installation or removal of the ink container of the ink jet unit in which the recording head and ink container are separable, the ink delivery portion of the ink container is horizontally slid toward the ink receiving portion of the recording head, and since it is installed through a sliding motion, a large space is required to slide the ink container.

In the color recording apparatus and particular, a full-color recording apparatus, four ink containers that correspond to four colors, respectively, are aligned in parallel with the scanning direction; therefore, the space that the ink containers occupy in the apparatus is rather large. More specifically, the connection space in which the ink containers are connected to the recording heads, that is, the projected area of the ink container relative to the bottom surface of the recording apparatus, is extremely large. As described above, when an attempt is made to apply the structure, in which the recording head and ink container are rendered easily separable, to the apparatus for recording color images, it invites an increase in the apparatus size due to the ink container structure.

As for the ink jet unit in which the recording head and ink container are integrated, a structure such as the one disclosed in U.S. Pat. Nos. 5,245,361 and 4,872,026 has been proposed, in which the ink jet unit is mounted through a rotary motion about a point near the recording head. In the case of such an ink jet unit, the recording head and ink container are pre-integrated; therefore, all that is needed is to provide a structure for fixing reliably the ink jet unit position on the carriage regardless of the connection between the two components.

However, when this installation method is applied to an ink jet recording unit in which the recording head and ink container are rendered independently separable, more specifically, when an attempt is made to connect the ink container to the recording head having been disposed on the carriage, it is extremely difficult to connect the two, which is apparent in consideration of the connection between the ink tapping pipe of the recording head and the ink delivery portion of the ink container.

SUMMARY OF THE INVENTION

The inventors of the present invention earnestly pursued solutions for the aforementioned problems. As a result, it was discovered that when the internal structure of the color ink (cyan, magenta, and yellow) storing container was devised so that the ink container could be vertically inserted to the recording head from above, through the rotary motion about an axial point on the lateral surface of the ink container, the projection area of the color ink container relative to the apparatus bottom surface could be reduced, and also, the space necessary for connecting the color ink container to the recording head could be reduced to a size small enough not to interfere with the other structural components.

Therefore, a primary object of the present invention is to provide an ink container structure capable of offering the largest ink capacity within a space allowed for the ink container, a method for installing such an ink container into the apparatus or removing it, and an apparatus into which such an ink container can be installed.

The present invention was made based on the aforementioned observations, and its primary object is to provide an ink container comprising a plurality of ink storing portions, each of which storing one of a plurality of types of ink to be supplied to the color recording head, wherein at least three color inks are partitioned from each other by the partitions that divide the internal space of the ink container.

Also, the present invention is characterized in that the supply ports, through which one of three types of ink is supplied to the corresponding recording head, are disposed near a point at which each ink storing portion is in contact with the other two.

Further, the present invention is characterized in that the ink container comprises a piece of ink absorbing material and an ink delivering member that delivers the ink out of the ink absorbing material, wherein the ink delivering member is composed of a fiber bundle and regulates the ink so that it flows only in one direction.

Further, the ink container in accordance with the present invention is characterized in that it is inserted into an ink container accommodating portion through a rotary motion about a point on the ink container, and the ink delivery port of the ink container has a conical surface, the diameter of which tapers inward.

Since a plurality of ink containers are not aligned in parallel with the scanning direction, the projection area of the ink container can be reduced.

Since the ink delivery port is disposed adjacent to a point at which each ink delivery port is directly in contact with the rest, the connecting space in which the ink containers are connected to the recording heads can be reduced.

The ink delivery port is given the conical surface; therefore, the ink container can be easily and reliably installed through a rotary motion.

With the use of a simple and inexpensive method, that is, just by placing an elastic sealing member between the ink delivery port of the ink container and the ink receiving portion of the recording head, a load inevitably imparted when the ink container is installed or removed can be reduced, whereby the ink is prevented from circumventing the junction, and also, the airtightness of the joint portion is improved to be further secured.

With the provision of ribs on the surface on which the ink delivery port is provided, the ink absorbing material can afford a portion that does not come in contact with the surface on which the ink delivery port is provided; therefore, the ink is prevented from concentrating in a particular area of the ink absorbing material.

Further, since the ink concentration is prevented, the ink supplying efficiency is improved.

Further, the ink is prevented from leaking out of the ink delivery port even when the ambient conditions change.

The object of the present invention is to provide an ink container comprising a plurality of ink storing portions that stores one of a plurality of inks to be supplied to a color recording head, wherein the internal space of the ink container is divided with substantially T-shaped partition walls so that at least three types of ink can be stored.

Another object of the present invention is to provide a method for installing an ink container into an ink jet unit that is installed into an ink jet recording apparatus, the ink jet unit comprising an exchangeable ink container for storing the ink and a casing for holding exchangeably the exchangeable ink container; in which the ink container is rotatively installed, in the direction perpendicular to the scanning direction of a carriage, which is provided within the main assembly so as to accommodate the ink jet unit and moves on a predetermined track; using, as a guide portion, the top edge of the front plate of the casing; and placing the ink container corner opposite to the guide portion, in contact with the internal casing wall surface opposite to the guide portion.

Another object of the present invention is to provide a method for removing an ink container from an ink jet unit having been installed in an ink jet recording apparatus, the ink jet unit comprising an exchangeable ink container for storing the ink and a casing for holding exchangeably the exchangeable ink container; in which the ink container is rotatively removed, in the direction perpendicular to the scanning direction of a carriage, which is provided within the main assembly so as to accommodate the ink jet unit and moves on a predetermined track; using, as a guide portion, the top edge of the front plate of the casing; and placing the ink container corner opposite to the guide portion, in contact with the internal casing wall surface opposite to the guide portion.

Another object of the present invention is to provide an ink jet unit to be installed in an ink jet recording apparatus, comprising: an ink container for storing ink; and a casing for retaining the ink container; wherein, the casing and ink container are rendered independent from each other so that the ink container can be exchangeably installed into the casing; wherein the casing comprises: an ink jet recording portion comprising ejection orifices for ejecting the ink delivered from the ink container, energy generating means for generating the energy to be used for ejecting the ink from the ejection orifices, and electrical contacts for applying a signal correspondent to the energy; a guide portion located at the higher point of the casing, as seen from the ink container accommodating side of the casing, so as to cause the ink container to be installed into an ink container accommodating portion through a rotary motion; and a shoe portion that is disposed on the downstream side of the ink container inserting direction and generates an insertion resistive feel when the ink container is inserted into the ink container accommodating portion, and wherein the shoe portion comprises pressing means for pressing the ink container onto the casing, and a dislocation preventive member located at a location different from where the pressing means is.

Another object of the present invention is to provide an ink jet recording apparatus comprising: an ink jet head that receives ink and ejects the ink; an exchangeable ink container that is exchangeably installed into, or removed from, the ink jet head, stores the ink, and supplies the stored ink to the ink jet head as needed; and a sealing member that seals the ink delivery junction formed between the ink container and ink jet head; wherein a rib is provided on either the sealing member or ink jet head, in such a manner as to be disposed between the two, and another rib is provided on either the ink container or sealing member, in such a manner as to be disposed between the two.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 2 is a schematic structural view of a multi-ink container in accordance with the present invention, in which color inks (yellow, cyan and magenta) are stored, wherein (a) is a partially cutaway side view; (b) is a partially cutaway front view; (c) is a bottom view; and (d) is a side view, in which the top portion has been cut away.

FIG. 14 is a schematic view of an elastic member, wherein (a)–(c) show its variations.

FIG. 15 illustrates a typical positional relation between the rib of the elastic member and that of the ink container.

DETAILED DESCRIPTION OF THE PREFERRED EMBODIMENTS

Hereinafter, the present invention will be described in detail with reference to the drawings.

Figures 1, 17A:
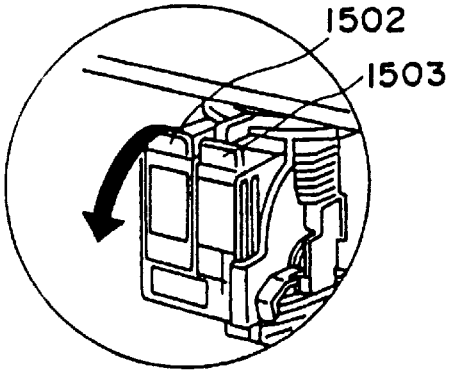
Figure 17A:
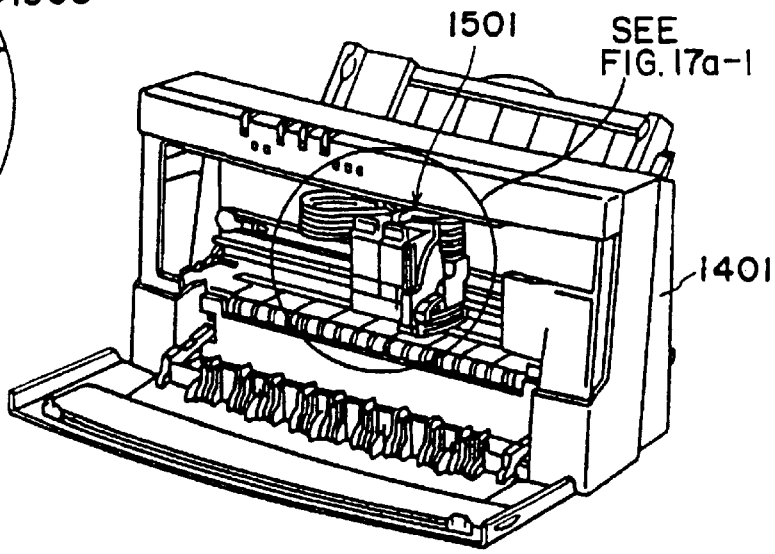
FIG. 17 illustrates an operation for removing the color ink container from the ink jet recording apparatus in accordance with the present invention; wherein (a) and (a-1) illustrate an operation to pull the ink container toward the front side, and (b) and (b-1) illustrate an operation to pull the ink container upward.
Figures 1, 17B:
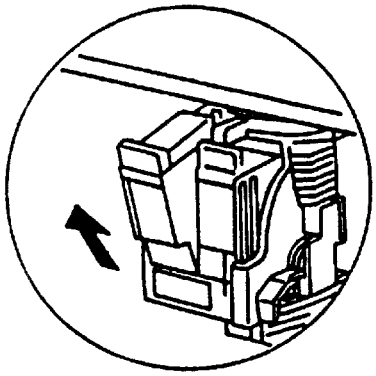
Figure 17B:
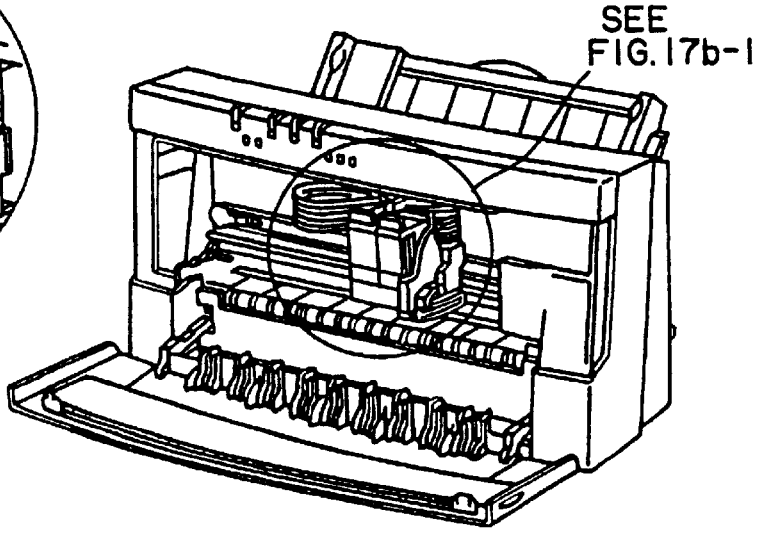
Figures 1, 18A:
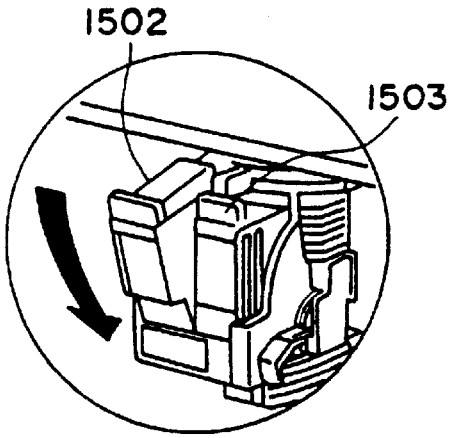
Figure 18A:
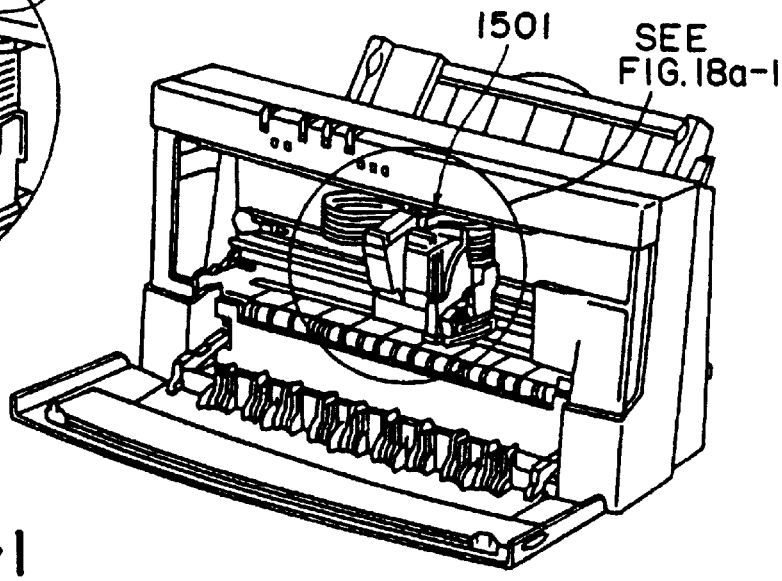
FIG. 18 illustrates an operation for installing the color ink container into the ink jet recording apparatus in accordance with the present invention, wherein (a) and (a-1) illustrate an operation to insert the ink container, and (b) and (b-1) illustrate an operation to push the ink container.
Figures 1, 18B:
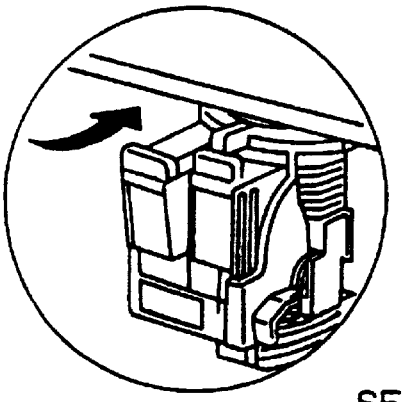
Figure 18B:
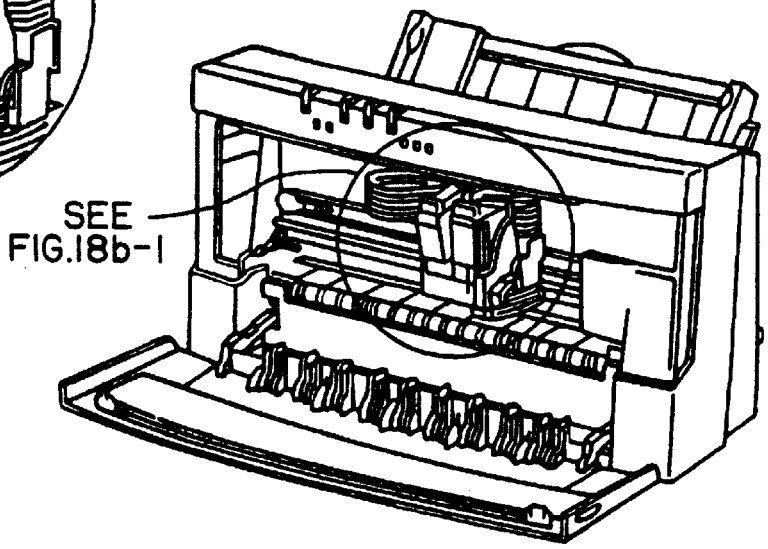

FIG. 1 is a schematic view of an ink jet unit or cartridge 101 that is mounted onto a carriage of an ink jet recording apparatus, wherein the ink jet unit comprises ink container accommodating portions 110 and 111.

As illustrated in FIGS. 1(*a, b*, and *c*), the ink jet unit 101 comprises a casing 103 constituted of a pair of side plates, or walls a rear plate or wall that connects this pair of side plates, a front plate or wall 113, and a middle plate 104 or partition. The front plate 113 is disposed so as to face the rear plate of the casing 103, forming a space between the rear plate and itself, and the ink container is accommodated in this space. The middle plate 104 divides the space into two portions, one of which becomes a color ink container accommodating portion or receptacle 110 and the other of which becomes a black ink container accommodating portion or receptacle 111. The height of the front plate 113 is approximately ⅓ of that of the casing 103, and an opening in the front plate 113 and top plate or wall 105 serves as a portion through which the ink container is inserted or removed.

There is a shoe portion at the inside of the top wall 105 near the back wall of the casing 103. It comprises a slanted camming shoe 105*a* that extends into the accommodating portions 110 and 111, tapering from the inserting side toward the accommodating spaces 110 and 111. The slanted portion of the camming shoe 105*a* is a portion for generating a resistive feel when the ink container is inserted. The shoe is disposed so as to come in contact with the rear end corner of the ink container corner relative to the ink container inserting direction, that is, the corner opposite to the ink delivery surface side. When the ink container is inserted, the resistive feel is increased by the inclination of the slanted portion of the camming shoe 105*a*, and as the corner of the ink container reaches a horizontal pressing means 105*b* of the shoe 105*a*, the resistive feel is eliminated and a feel of clicking is felt. The pressing means 105*b* generates a downward force that works to press down the ink container toward the bottom.

The ink jet unit 101 further comprises the ink tapping pipes 107Y, 107M (unillustrated), 107C, and 107Bk (unillustrated) that tap the ink within the ink container and introduce it toward a recording head portion 201 comprising nozzles 201Bk, 201C, 201M, and 201Y. They are disposed at the outside of the bottom wall of; and the ink jet unit 101, upstanding (projecting) a predetermined length into the accommodating portions so that they can be inserted into the corresponding ink containers.

Referring to FIG. 1, filters 109(Y, M, C, or Bk) are provided on the corresponding ink tapping pipes 107, at the opening within the color ink container accommodating portion 110 and the black ink container accommodating portion 111. They project a predetermined length into the accommodating portions so that they can be inserted into the corresponding ink containers.

Referring to FIG. 1(*d*), the connection between the tapping pipes 107 and the recording head is made with in delivery tubes 106(Y, M, C, or Bk) disposed on the bottom surface of the recording head.

The accommodating portion bottom surface, on which the tapping pipe 107 is disposed, is covered with an elastic plate 108(*a, b*) of a predetermined thickness, on the immediate area surrounding the tapping pipe 107. The elastic plate 108(*a, b*) will be described later. A rib provided at the ink delivery port of the ink container, or a rib provided on the elastic plate 108 itself, is compressed to secure the hermetical connection between the ink container and the bottom portion of the ink jet unit so that the ink is prevented from leaking into the internal space of the ink jet unit.

Referring to FIG. 1(*c*), a notch 112 is provided on the front plate 113, at a location facing the accommodating portion 111. This notch 112 allows a rib provided on the black ink container, in which the black ink is stored, to pass, preventing thereby faulty insertion caused by the mixup between the black ink container, and the multi-ink container storing the yellow, magenta, and cyan color inks.

The black ink container storing the black ink is installed into the accommodating portion 111 of the ink jet unit 101, and the color ink container storing the yellow, magenta, and cyan color inks is installed into the accommodating portion 110.

Next, a typical structure of a color ink container or tank 21 that is installed into the accommodating portion 110 will be described with reference to FIG. 2. Referring to FIGS. 2(*a, b, c*, and *d*), the color ink container 21 storing the color inks (in this example, yellow Y, cyan C, and magenta M) is formed as a single piece component for storing these inks.

Referring to FIG. 2(*c*), the color ink container 21 comprises an ink containing shell 22 and T-shaped partition member with a cross portion 36 and an elongated portion 37. The internal space of the ink container shell 22 is divided into independent spaces by the combination of the partition members 36 and 37. The amounts of the color ink storable in each of these divided spaces are substantially the same. The reason why the internal space of the ink container is divided as illustrated in FIG. 2(*c*) is that such division allows the ink supply ports to be disposed adjacent the boundaries among the storing species.

When the internal space of the ink container is partitioned as described in the foregoing, and the ink supply ports are disposed close to the point at which each ink storing space is directly in contact with the other two, the space required for connecting the ink container to the recording head can be reduced to an extremely small one, and the projection area of the ink container is also reduced. In addition, the ink storing capacity of the ink container can be larger relative to the projection area and connecting space.

As for the dimension of the ink container having such a structure excluding a top member 24, the height is approximately 56.5 mm; depth at the top, approximately 38.4 mm; depth at the bottom, approximately 31.5 mm (depth at the mid section, approximately 34.5 mm); width at the top, approximately 19.3 mm; width at the bottom, approximately 18.1 mm; and the height from the bottom to a stepped portion is approximately 29.5 mm. The stepped portion is located substantially at the halfway point between the top and bottom portions.

The rest of the essential ink container structure is similar to that of the ink container 1 which will be described later. The ink container 21 comprises the ink storing shell 22, a top cover 23, and a top member 24. The cover 23 is provided with an air venting opening 25 (Y, M, and C; M and C are unillustrated) and covers the shell 22. The top member 24 is provided with: a space or plenum that serves as a buffer chamber for preventing the ink, which leaks out of the air vent 25, from reaching the outside; an air vent disposed so as not to face directly the air vent 25; and a tab 24*a* to be used as a handle when the ink container 21 is inserted into, or taken out of, the ink jet unit 101.

The bottom portion or wall of the ink container comprises: an ink delivery port 28 into which the tapping pipe 107 (Y, M, and C) of the ink jet unit 101 is inserted; a rib 35 that projects around each ink delivery port 28; a slanted portion 34*a* that connects the ink delivery port 28 (Y, M, or C) and rib 35 (Y, M, or C). Since the ink container 21 is inserted into the ink jet unit 101 through its rotary motion, which will be described later, the ink delivery port 28 (Y, M, or C) is given a gently slanted surface, on the slanted portion 34*a* side, so that the ink delivery port 28 is prevented from disrupting the smooth insertion of the ink container as it comes in contact with the tip of the tapping pipe 107. Precisely describing, the inclination of the ink delivery ports 28Y and 28M of the yellow and magenta ink containing portions, respectively, into which the tapping portion 107 first penetrate, are rendered gentler than that of the ink delivery port 28C of the cyan ink containing portion.

When the inclination is rendered gentler on the upstream side, relative to the direction in which the ink container is rotated when inserted, the ink delivery port 28 (Y, M, and C) does not strike the tapping pipe 107 while the ink container is rotated; therefore, the ink container can be more smoothly inserted through a rotary motion that can take place in a smaller space. Further, a sliding pullback motion toward the front, relative to the inserting direction, that must take place just before the inserting motion ends can be smoother. This sliding pullback motion will be described later.

Referring to FIG. 2(*a*), members of ink absorbing material 26 (Y, M, and C) are stored within the internal space of the corresponding ink containers, and ink delivering members 27 (Y, M, and C) are disposed between the corresponding ink absorbing material (Y, M, and C) and ink delivery ports 28 (Y, M, and C). In order to hold the ink delivering members 27 (Y, M, and C) within the corresponding ink containers, supporting members 29 (Y, M, and C) are provided, and a slit that connects the internal space to the ambience is provided on each of the supporting members 29 (Y, M, and C), on the inward facing surface.

The cover 23 comprises a rib 33 and a ridge 23*a*. The rib 33 comprises spacers that provide a predetermined gap between the ink absorbing material and cover 23. The ridge 23*a*, being on the external side of the cover 23, engages with the shoe portion 105 of the ink jet unit 101 and generates a downward force that presses the ink container 21 downward, securing the installed ink container.

Further, a plurality of ribs 31 are provided on the lateral internal surface of the ink container. These ribs 31 create a predetermined gap between the lateral internal surface of the ink container and the ink absorbing material 26.

Referring to FIG. 2(*c*), in the case of this ink container 21, all of the ink delivery ports 28 (Y, M, and C) are disposed on one side of the bottom surface, which is liable to cause the ink absorbing material to adhere airtightly to the other side of the bottom surface. When the ink absorbing material adheres airtightly to the bottom surface of the ink container, the ink is liable to be collected thereto, and when collected, it is liable to leak out of the ink delivery ports or air vents, depending on the orientation of the ink container. In order to correct such a fault, the ribs 30 are provided within each ink storing portion of the ink container 21, on the bottom surface, so that the ink absorbing material can be prevented from adhering, leaving no gap, to the bottom surface of the ink container.

The presence of such ribs 30 and ribs 31 in the ink container (also, the presence of the slit on the supporting member 29) allows the ink delivery ports 28 and air vents 25 to be connected with an air layer.

With the presence of such an air layer that connects the internal space of the ink container to the outside;

firstly, when the sealing member, which seals the ink delivery port during the commercial distribution of the ink container, is peeled off, the ink is prevented from blowing out, or leaking, from the ink delivery port;

secondly, even when the ambient temperature of the ink container increases during a printing operation, the ink is not going to be forced out; and thirdly, the provision of the rib 30 prevents the ink from collecting at the ink container bottom, offering an effect of improving the ink delivery efficiency.

FIG. 3 illustrates a general structure of an ink container or tank 1 for storing the black ink, wherein (a) is a partially cutaway side view; (b) a front view; (c) a bottom view; and (d) is a partially cutaway top view.

The ink container 1 comprises an ink storing shell 2, a top cover 3, and a top member 4. The cover 3 is provided with an air venting opening 5 and covers the shell 2. The top member 4 is provided with: a space or plenum that serves as a buffer chamber with baffles 4' for preventing the ink, which might leak out of the air vent 5, from reaching the outside; an air vent disposed so as not to face directly the air vent 5; and a tab 4*a* to be used as a handle when the ink container 1 is inserted into, or taken out of, the ink jet unit 101.

The bottom portion of the ink container comprises: an ink delivery port 8, into which the tapping pipe 107 (Bk) of the ink jet unit 101 is inserted; a rib 15 that projects around the ink delivery port 28; slanted portions 14*a* and 14*b* that connect the ink delivery port 8 and the rib 15. Further, a rib 12 is provided on a part of the lateral surface, on the tab 4*a* side of the ink container 1. This rib 12 serves to prevent the erroneous ink container 1 installation, in coordination with a notch 112 provided on the front plate 113 of the accommodating portion 111 of the ink jet unit 101. This rib 12 is also used as a guide for installing the ink container 1.

The present invention does not limit the design of the internal structure of the ink container. However, the present invention is particularly effective when an ink supplying member (hereinafter, called ink delivering member) constituted of bundled fibers is provided within the ink delivering portion containing the elastic member.

When the ink delivering member constituted of this type of bundled fibers is employed, it is preferred that the ink container is installed in such a manner that the bundled fibers is pressed upon the filter-equipped ink tapping pipe on the recording head side and remains in a stable state of being compressed. Such stability can be effected by any installation method in accordance with the present invention.

The ink delivering member described in the foregoing takes a form such as that of an ink delivering member 7 illustrated in FIG. 3(*a*). In the present invention, it is preferred that the ink delivering member 7 disposed between the ink absorbing member 6 and ink delivery port 8 as shown in this drawing is constituted of ink absorbing material, and that the bundled fiber member is placed at least on the surface that faces the ink container. However, it may be constituted of only ink absorbing material such as sponge, without the addition of the bundled fibers. Further, in order to support the ink delivering member 7 in the ink container, a supporting member 9 is provided, erecting inward from the ink delivery port 8, and a slit for establishing communications between the internal space of the ink container and the outside is provided on a part of the inward facing surface of this supporting member 9.

Here, the ink delivering member 7 is an ink drawing member that delivers the ink only in one direction, and in this embodiment, it delivers the ink from the ink absorbing material toward the ink delivery port 8.

In this embodiment, ink absorbing material is employed as the porous material to be placed in the ink storing portion of the ink container, and is compressed into the storing portion. As for the ink absorbing material, sponge or the like, for example, can be listed.

The ink delivering member 7 is fixed to a holder portion of the ink jet unit, and remains pressed upon the compressed ink absorbing material 6 stored in the ink storing portion, keeping the ink absorbing material 6 compressed at the contact point. This deformation boosts the capillary force, enabling the ink absorbing material 6 to collect the ink into the adjacent area of the ink delivering member 7.

Thus, even when the recording head and ink container are separated from each other, a sufficient amount of the ink is always available to the ink delivering member 7, forming a meniscus on the surface of the ink delivering member 7, on the ink delivery port side, and preventing thereby the air from being drawn in.

Further, after the recording head and ink container are connected and an ink passage is established, it enhances the ink flow toward the ink delivering member 7, preventing the ink flow interruption, and reducing thereby the amount of the ink left unused; therefore, the ratio of the usable ink stored in the ink container improves.

When the ink absorbing material is stored compressed in the ink storing portion, the ink absorbing material remains pressed upon the ink delivering member, being deformed. Therefore, the employment of the structure such as the one illustrated in FIG. 3(*a*), in which the ink delivering member is pressed upon the ink absorbing material, further deforms the ink absorbing material in the area next to the contact point; therefore, more ink is collected in the area next to the contact point.

When ink absorbing material that is less compressible during its placement into the ink storing portion, or has a smaller elastic coefficient, is employed, it is preferred for the ink delivering member to be "pressed into" the ink absorbing material so that the ink absorbing material is surely deformed to reliably collect the ink to the contact point.

It should be noted here that a terminology "pressed into" means that a higher pressure than that applied when the preferred material is employed is used to press the ink delivering member onto the ink absorbing material so that a higher contact pressure can be generated.

Generally speaking, in the case of the ink jet recording apparatus, the printing quality deterioration caused by the ink leak from the ejection orifices of the recording head or the lack of ink supply to the ejection orifices is prevented by maintaining a proper balance in the water head pressure at the ejection orifice portion of the recording apparatus. In order to stabilize the ink jet recording apparatus performance, it is necessary to maintain a negative pressure in the ink supplied to the ink jet recording head (generally, no more than 0 mmAq and no less than −150 mmAq, preferably, no more than −30 mmAq and no less than −100 mmAq).

As the ink jet recording head and ink container are connected, the filter in the ink jet recording head makes airtight contact with the ink delivering member, generating a predetermined contact pressure.

This contact pressure is affected by the height the ink tapping portion from the recording head, and also, by the distance from the external surface of the ink container, which is abutted against the recording head, and the contact surface at which the ink importing portion of the recording head side makes contact with the ink delivery portion of the ink container, that is, the depth of the ink delivery port.

This connection creates an ink flow passage that extends from the porous member within the ink container to the ink importing portion on the recording head side, through the ink delivering member, enabling the ink to be delivered to the recording head.

Further, an O-ring is disposed between the recording head and ink container, so that the ink flow passage, which is established as the ink importing portion and ink delivery port are connected, can be maintained airtight. In addition to preventing the ink leak at the junction, it can also minimize the ink evaporation at the junction. Examples of a preferable sealing member such as this one will be described later.

The ink delivering member 7 is normally constituted of bundled fibers. As to the appropriate fiber material, polyester, nylon, polypropylene, polyethylene, cellulose, polyurethane, or the like is available. In other words, the material is preferred to be chemically stable against the ink, and display a preferable level of wettability.

As for a criterion for determining whether or not material has the preferable level of wettability, the ink contact angle is generally used; having a small ink contact angle is preferred. It is possible to use even a material such as so-called Teflon group material that displays a large ink contact angle, as long as it is treated to give it hydrophilicity. However, in consideration of a number of manufacturing steps to be increased for giving the hydrophilicity, and the resultant produce cost increase, the material that displays the small contact angle is preferable.

As for the fiber material other than those described previously, fiber material such as metallic fiber, glass fiber, carbon fiber, or the like may be employed. These materials may be mixed with the previously mentioned materials.

Since the ink delivering member constitutes a part of the ink flow passage, it must be given such properties that allow the ink to be delivered only in one direction. Also, since it presses upon the ink receiving portion of the recording head, its must be given physical strength for maintaining its shape; therefore, the fiber material is preferred to be bundled.

The condition for determining the upper limit of the thickness of the strand of the fiber material that constitutes the ink delivering member is the airtightness between the aforementioned filter provided in the ink importing portion and the ink delivering member. From this point of view, a thickness of no more than 0.05 mm is desired. Further, as for the condition for determining the lower limit of the thickness of the fiber strand, a thickness of no less than 0.01 mm is preferable, in view of the employed structure in which the ink delivering member is constituted of the bundled fiber.

Further, as means for keeping the fiber material bundled, there is a method in which the fiber material is hardened, at the circumference of the bundled fiber material, with bonding material of resin (binder). The application of this method forms a hardened portion at the peripheral portion of the ink delivering member.

As for the resin that is impregnated from the periphery of the bundled fiber material, polyurethane of polyester polyol, or the binder of melamine group (if suitable), may be used.

As means for forming a hard shell that keeps the fiber material permanently bundled, in addition to the aforementioned method in which the resin binder is used, a different method may be employed, in which heat or pressure is applied to fuse the peripheral portion of the bundled fiber material. Further, instead of forming a hard shell, the bundled fiber may be covered with different material.

In the case of the method in which a hard shell is formed, the binder can be impregnated at the same time as the fiber is bundled. In contrast, in the case of the method in which a different covering material is employed to keep the fiber material permanently bundled, the covering material must be placed over the temporarily bundled fiber material while giving uniform strength to the fiber bundle, which complicates the manufacturing process. Therefore, the structure comprising the hard shell is considered preferable.

As to the method for bundling the fiber material, it is not limited to the aforementioned structures and methods. Any method or structure is acceptable as long as it enables the fiber bundle to convey the ink only in one direction, and as long as it does not cause the fiber bundle deformation, which might prevent the ink delivery or cause non-uniform ink delivery, when the fiber bundle is pressed against the ink importing portion of the recording head.

Referring to FIG. 3(*d*), ribs or spacers 13 are disposed on the top member 4 in such a manner that they create a predetermined amount of space between the ink absorbing material 6 and the top member 4, and a ridge 3*a* is provided on the cover 3, on the exterior side.

A certain consideration is given to determine the ink container dimension so that when the corner portion 2*a* of the ink container comes in contact with the aforementioned slanted portion of the camming shoe 105*a*; of the ink jet unit 101, the feel of resistance gradually increases during the ink container insertion. As soon as the corner portion 2*a* engages with the pressing means 105*b* provided on the shoe portion 105*a*, the feel of resistance instantly disappears, and at the same time, the user feels a "click" in his hand, confirming that insertion has been properly completed. This pressing means 105*b* generates a downward force that presses the ink container 1 downward, further securing the inserted ink container 1.

The aforementioned ridge 3*a* engages with the dislocation preventive member 105*c*, preventing the ink jet unit from becoming dislocated. The dislocation preventive member 3*a* is also disposed on the top wall 105 provided on the ink jet unit 101, at a location different from where the aforementioned slated camming shoe 105*a* is disposed.

The significant effects of the present invention, such as space saving and such that the user can reliably confirm the proper ink container insertion, is accomplished through the combination of: the shapes of the slanted portion of the camming shoe 105*a* and pressing means 105*b* at the top wall 105, and the placement thereof; the horizontal and vertical dimensions of the ink container, and the relation thereof; and the dislocation preventive portion that generates a positive feel of resistance when the ink container is dislocated.

Further, a number of ribs 13 that horizontally extend are provided on the interior surface of the ink container, forming a predetermined amount of space between the interior surface of the ink container and the ink absorbing material.

It should be noted that this ink container 1 is formed so that the ink delivery port 8 is disposed on one side of the bottom surface of the ink container. Therefore, the ink absorbing material is liable to adhere airtightly to the other side of the bottom surface of the ink container. When the ink absorbing material adheres airtightly to the bottom surface of the ink container, the ink is liable to be collected thereto, and when collected, it is liable to leak out of the ink delivery port or air vent, depending on the orientation of the ink container. In order to correct such a fault, the ribs 10 are provided within the ink storing portion of the ink container 1, on the bottom surface, so that the ink absorbing material can be prevented from adhering airtightly to the bottom surface of the ink container.

In addition, a number of horizontally extending ribs 11 are provided within the ink container, on the lateral surface, forming a predetermined amount of space between the lateral wall surface and ink absorbing material.

The presence of such ribs 10 and ribs 11 in the ink container (also, the presence of the slit on the supporting member 9) allows the ink delivery port 8 and air vent 5 to be connected with an air layer.

With the presence of such an air layer that connects the internal space of the ink container to the outside;

firstly, when the sealing member, which seals the ink delivery port during the commercial distribution of the ink container, is peeled off, the ink is prevented from blowing out, or leaking, from the ink delivery port;

secondly, even when the ambient temperature of the ink container increases during a printing operation, the ink is not going to be forced out; and thirdly, the provision of the rib 10 prevents the ink from collecting at the ink container bottom, offering an effect of improving the ratio of the usable ink.

Further, in order to reduce the projection area of the ink container 1 relative to the recording head, and at the same time, to increase the ink capacity of the ink container 1, the surface area of the bottom portion of the ink container 1 is reduced, and at the same time, the height of the ink container is increased; in other words, so-called aspect ratio is increased to accomplish such objectives. In addition, the ink container 1 is stepped substantially at the middle to increase its ink capacity. This stepped design gives such an effect that the ink container appears to be an integrated part of the ink jet unit after it is inserted in the unit.

As for the external dimension of the ink container 1, excluding a top member 4, the height is approximately 51.4 mm; depth at the top, approximately 38.4 mm; depth at the bottom, approximately 34.9 mm; rib 12 depth, approximately 2.7 mm; width at the top, approximately 16.9 mm; width at the bottom, approximately 11.1 mm; and the height from the bottom to a stepped portion is approximately 24.4 mm. In other words, the ink container is shaped so as to expand once in a slight step, substantially at the halfway point between the top and bottom portions.

The ink container 1 and color ink container 21, which comprise the aforementioned structure, are installed into the ink jet unit 101, through rotary motion caused by the multiple contacts between the ink container and the portions of the casing, that is, the top portion 114 of the top plate 113, the lateral internal surface of the casing, and the like.

In order to save the space needed for insertion, the ink container is inserted in such an orientation with the bottom wall of the ink container facing downward and its back wall facing the back wall of the ink cartridge such and that the ink container surface opposite to the guide portion of the ink cartridge casing forms an angle (θ in FIG. 4) of 5°–45°, relative to the casing surface having the guide portion. When the angle falls outside this range, the space needed for the insertion is practically not different in comparison with that needed if the ink container is linearly inserted from above or sideways.

FIGS. 4–10 illustrate a typical ink container installation sequence, in particular, for the color ink container 21.

Figures 1A, 1B, 1C, 1D, 1E:
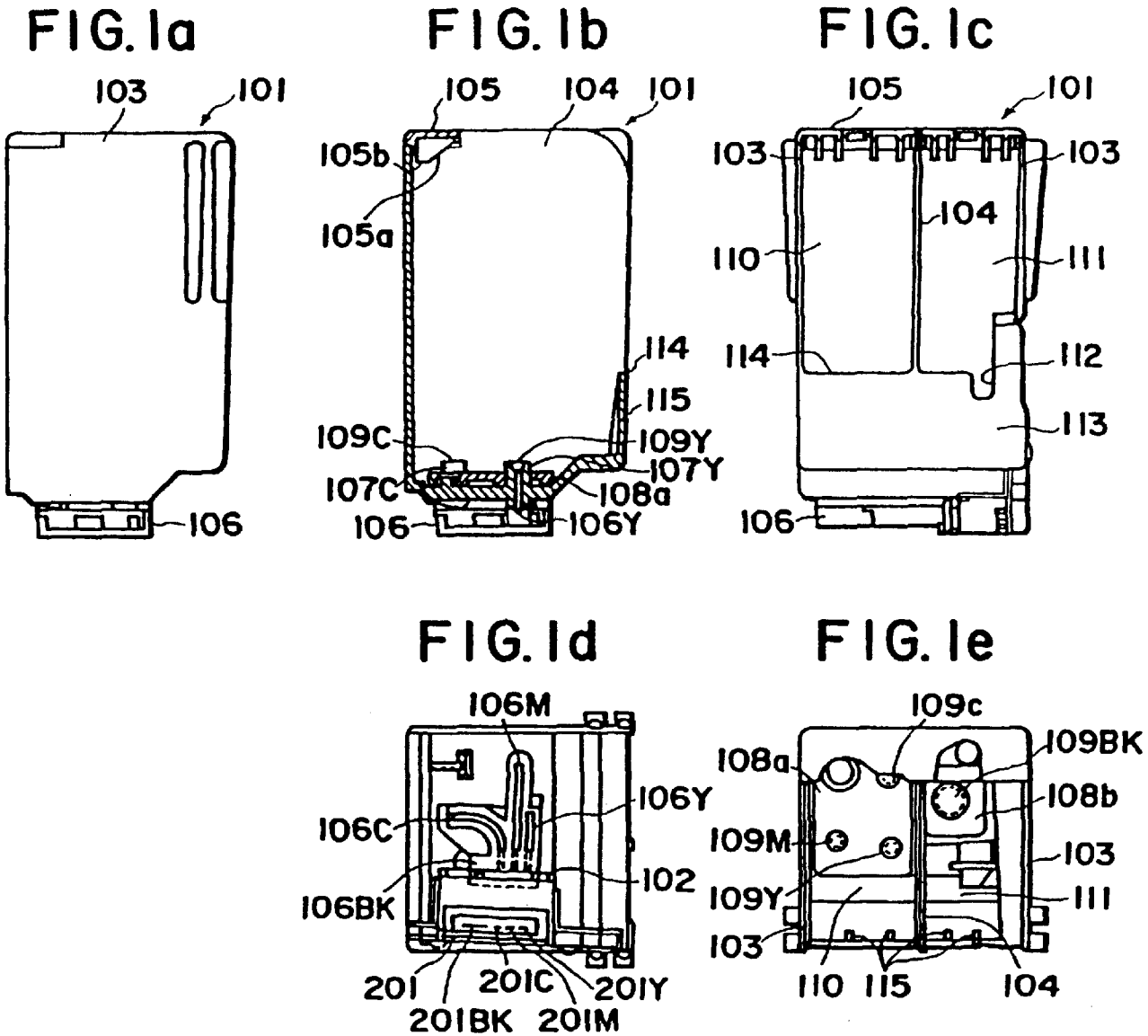
FIG. 1 is a schematic structural view of an ink jet unit on which an ink container in accordance with the present invention is mounted, wherein (a) is a side view; (b) is a partially cutaway side view; (c) is a front view; (d) is a bottom view; and (e) is a top view.
Figure 3A:
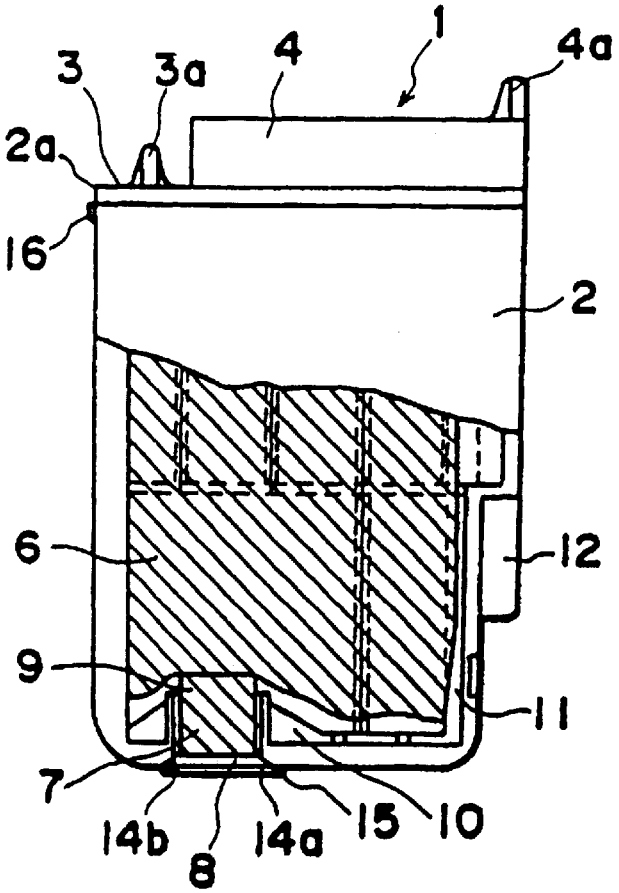
FIG. 3 is a schematic structural view of an ink container in accordance with the present invention, in which black ink is stored, wherein (a) is a partially cutaway side view; (b) is a partially cutaway front view; (c) is a bottom view; and (d) is a side view, in which the top portion is partially cut away.
Figure 3B:
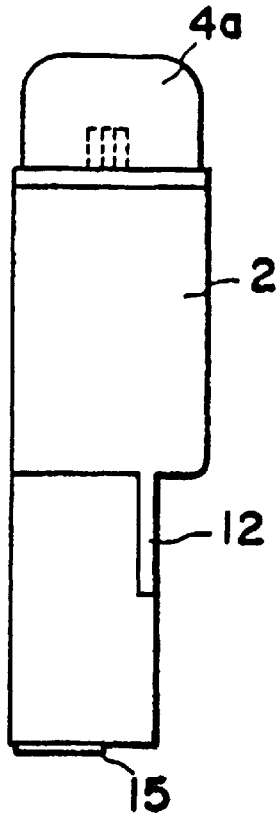
Figure 3C:
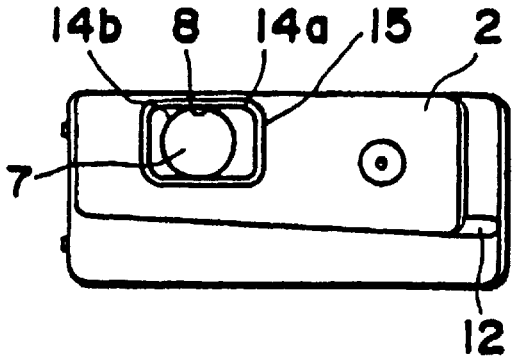
Figure 3D:
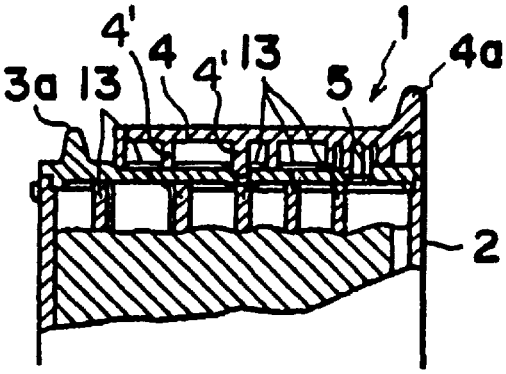
Figure 4:
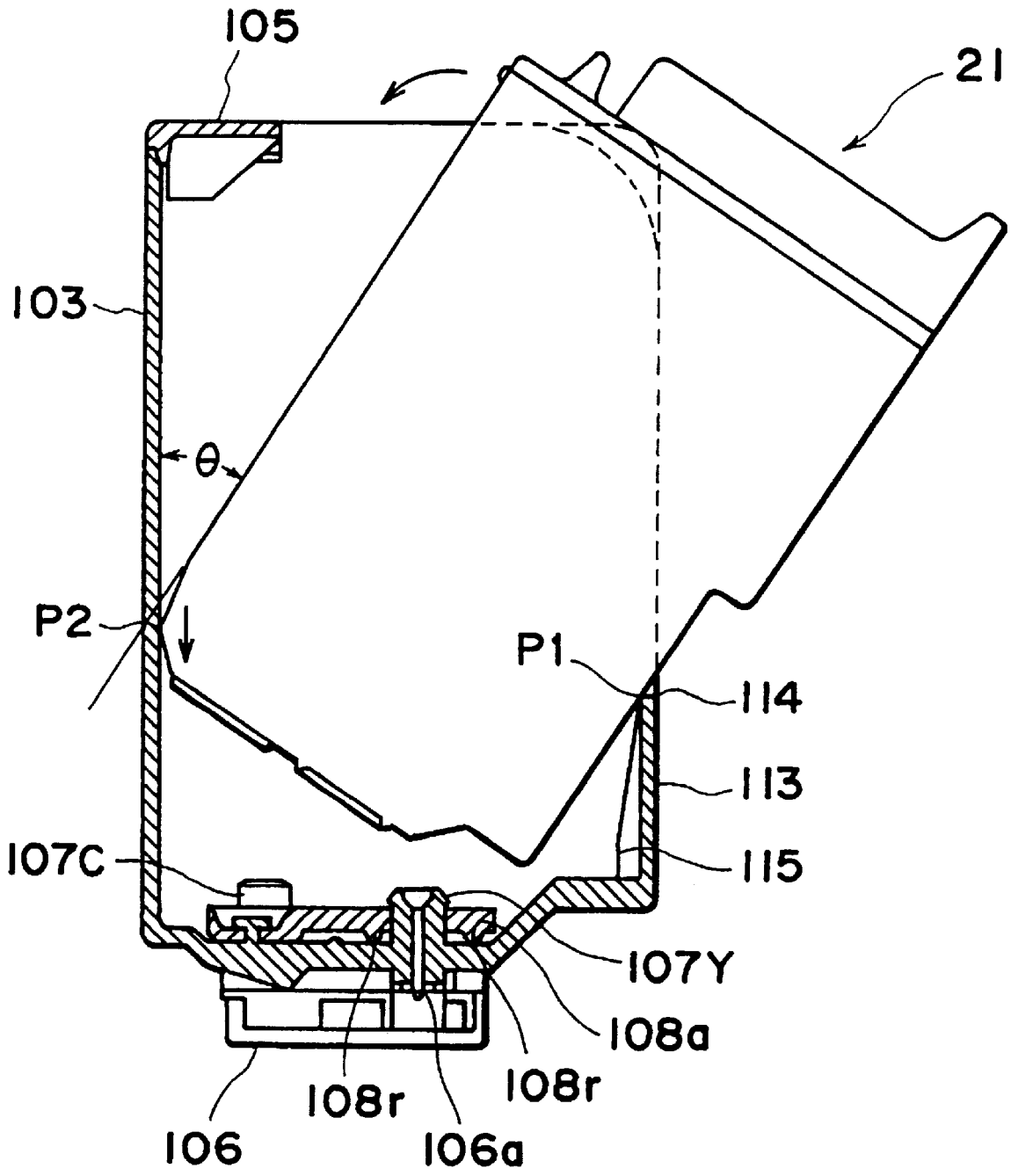
FIG. 4 is a schematic section that depicts an embodiment of a color ink container in accordance with the present invention, being in a stage I of a container mounting process for installing the container into the ink jet unit.
Figure 5:
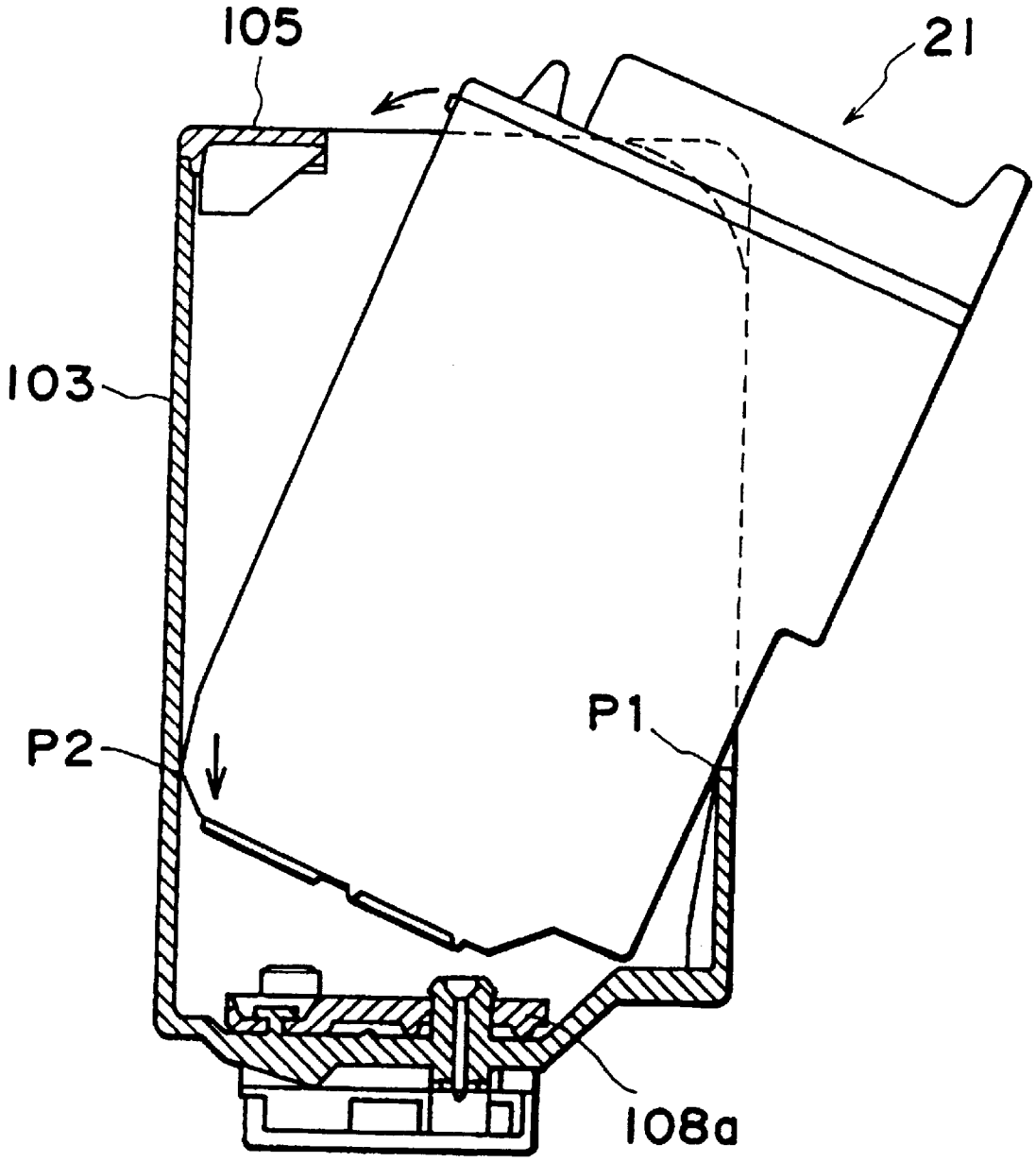
FIG. 5 is a schematic section that depicts the embodiment of the color ink container in accordance with the present invention, being in a stage II of the container installing process for installing the container into the ink jet unit.
Figure 6:
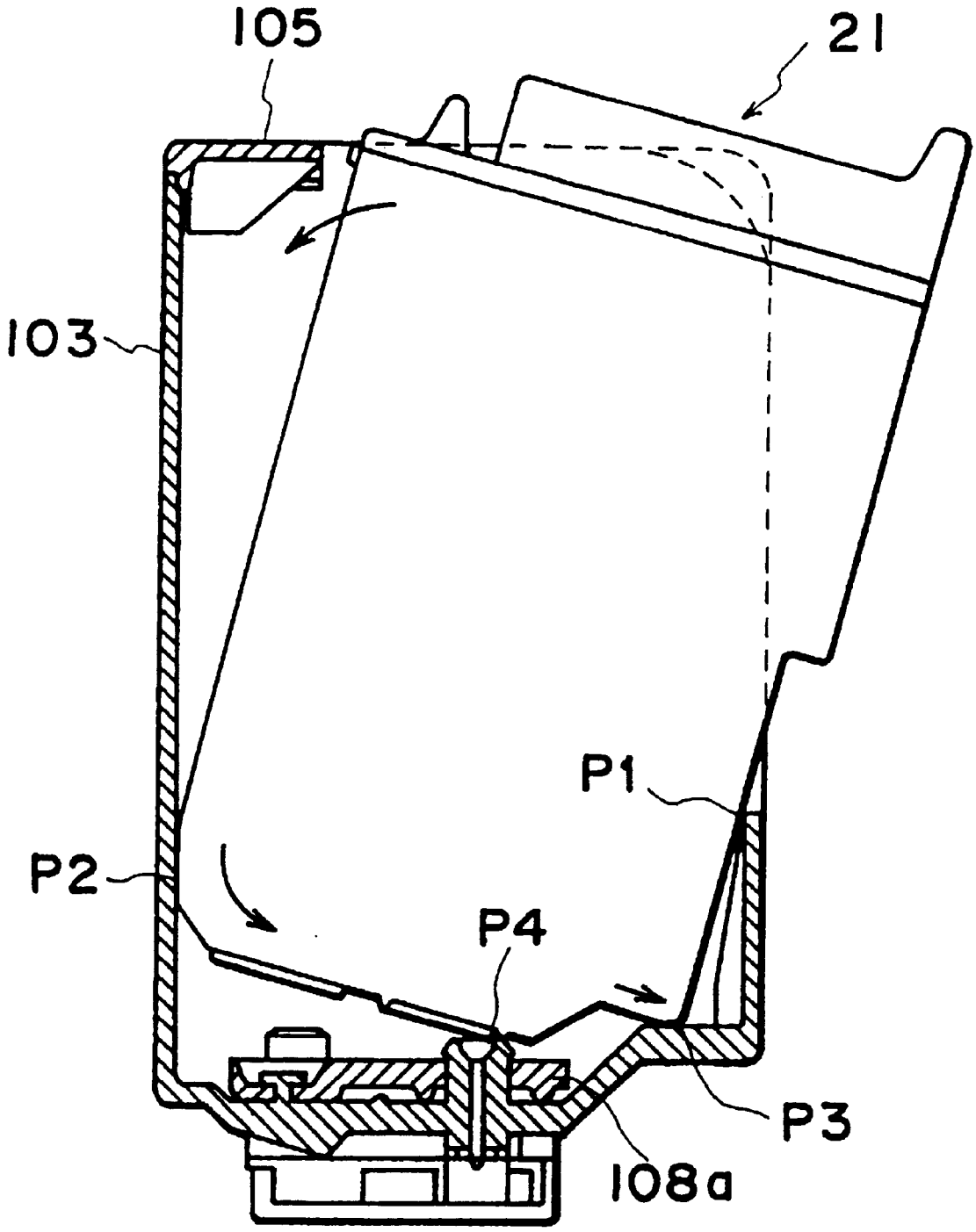
FIG. 6 is a schematic section that depicts the embodiment of the color ink container in accordance with the present invention, being in a stage III of the container installing process for installing the container into the ink jet unit.

First, referring to FIG. 4, the ink container 21 is picked up by the tab portion, and is inserted into the ink container accommodating portion, as illustrated by a state I. At this time, the top portion 114 of the front plate 113 is placed in contact with a point (P1) of a lateral wall of the ink container, being used as the guide, and one (P2) of the bottom corners of the ink container is placed in contact with the back wall of the casing 103. Then, the bottom corner P2 is gradually slid downward, whereby the ink container is rotated about P1, settling in a state illustrated in FIG. 5. As the bottom corner P2 is further slid downward, a state III is realized (FIG. 6).

It is extremely important, at this time, that the user can feel with his hand that the ink container is smoothly sliding. In this embodiment, this is accomplished by giving an R-shape (approximately R3) to the ink container corner (P2) that is abutted on the back wall surface of the casing 103. This provision of the R-shaped corner allows the ink container to slide smoothly, being virtually rotated about the contact point P1 established between the ink container and the top portion 114 of the front plate 113; therefore, the ink container is smoothly slid downward as the contact points P1 and P2 are allowed to shift smoothly in coordination, giving the user a preferable feel of contact.

When the ink container is in the state III, the other bottom corner portion P3 of the ink container, which has reached the internal bottom portion of the casing 103, is in contact with the casing 103, and as the ink container is further inserted, the slanted portion, which is formed so as to continue from the R-shaped portion given to the other bottom corner P3, comes in contact with the internal wall of the casing 103. In the FIG. 6 that illustrates the stage III, the ink tapping pipe 107Y is ready to enter the ink delivery port of the ink container (it should be noted that the ink tapping pipe 107M is also ready to enter the ink delivery port of the magenta ink container disposed next to the yellow ink container). However, when the ink tapping pipe 107 comprises the aforementioned ink delivering member constituted of the fiber bundle, the fiber bundle is sometimes damaged through the friction between the fiber bundle and ink delivery port; therefore, it is preferable that the dimensions of the casing and ink container are adjusted so that the ink tapping pipe does not come in contact with the ink delivery port of the ink container, in the state III, and a state IV, which will be described.

At this time, the tip of the ink tapping pipe 107 contacts the ink delivery port, but, since the port is given the slanted surface as illustrated in FIG. 2(*c*), the insertion continues without a hitch.

Further, since the ink container goes through the rotational movement during its installation, each ink tapping pipe comes in contact with the corresponding ink delivery port at a different time, depending on where each ink delivery port is located; therefore, the inclination of its slanted surface is rendered gentler in the order of its contact with the corresponding ink tapping pipe. In other words, the yellow and magenta ink containers are provided with a slanted surface having substantially the same inclination, and the slanted surface of the ink delivery port of the cyan ink container is the most inclined.

Since the ink delivery port portion is provided with the slanted surface, and its inclination is rendered gentler on the upstream side relative to the direction in which the ink container is inserted into the casing, and is rendered steeper on the opposite side, the ink container can be rotated for the installation, being disposed right next to the port portion, and yet, without causing the ink tapping pipe 107, which is to be connected to the ink container while the ink container is rotatively inserted in the casing, to interfere with the port portion, and also, the ink delivery port portion can be designed without being expanded more than an ordinary one.

Now then, as the insertion is continued, the bottom portion P3 of the ink container, at which the ink container also comes in contact with the casing, slides and shifts toward the front side, causing the ink container to be inclined against the slanted portion of a rib 115, which is provided on the casing 103, on the internal surface of the front wall 113.

Figure 7:
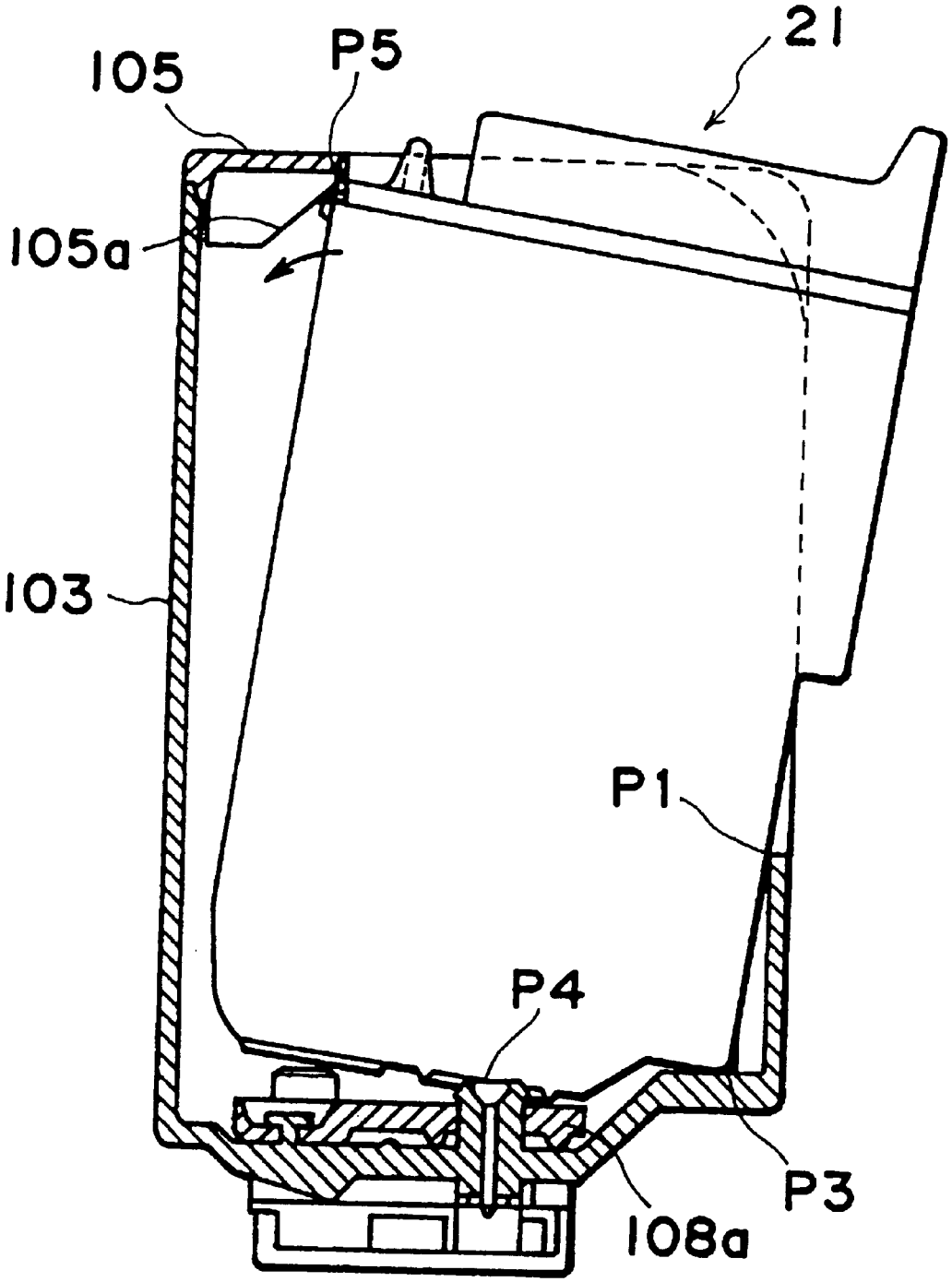
FIG. 7 is a schematic section that depicts the embodiment of the color ink container in accordance with the present invention, being in a stage IV of the container installing process for installing the container into the ink jet unit.

At this time, the top corner P5 of the ink container, that is, the corner on the downstream side relative to the vertical direction in which the ink container is inserted, comes in contact with the top end of the camming slanted portion provided on the shoe 105*a*, and begins to generate the insertion resistive feel (state IV illustrated in FIG. 7).

Figure 11A:
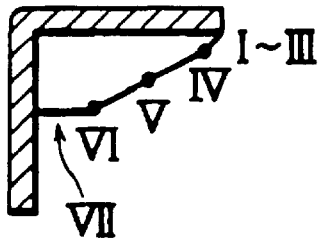
FIG. 11 is a drawing for depicting the relation between the position of a point P5 on the container during an operation for inserting the color ink container in accordance with the present invention, and the force resisting the insertion, wherein (a) indicates the P5 positions corresponding to the stages I–VII, and (b) is a graph showing the relation between the P5 position and the force that resists the insertion.
Figure 11B:
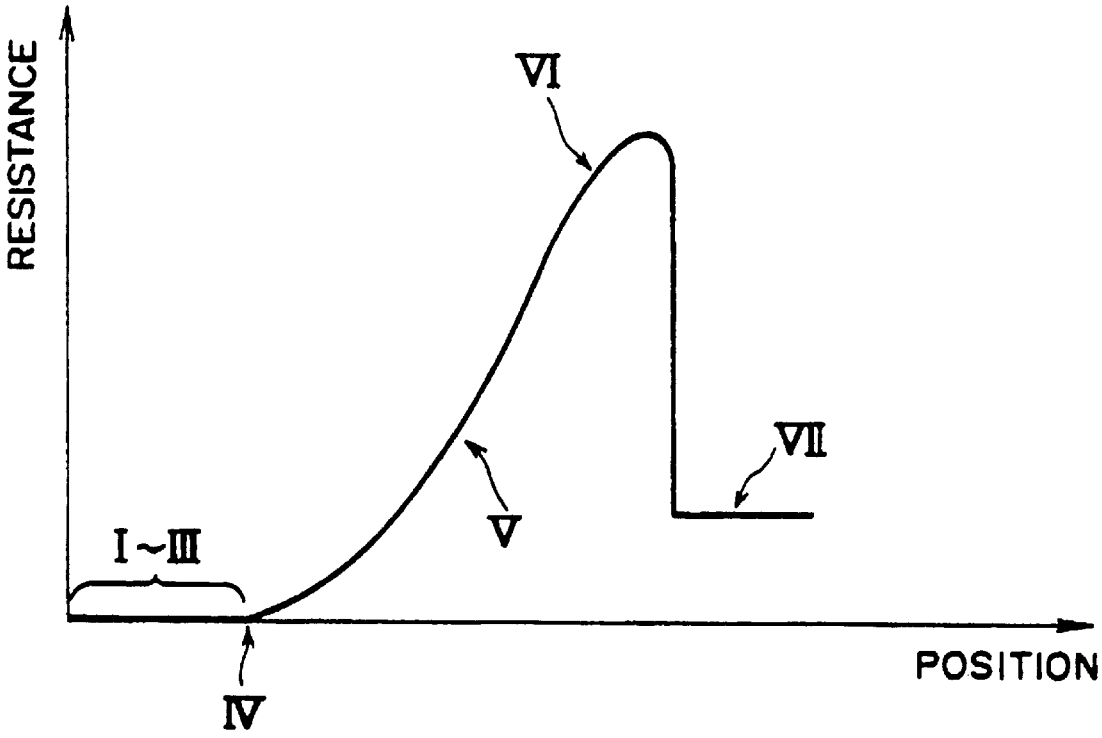
Figure 12A:
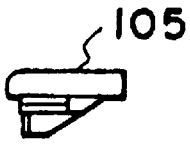
FIG. 12 is a drawing for describing a shoe portion of the casing of the ink jet unit in accordance with the present invention, wherein (a) is a side view; (b) a front view; (c) a bottom view; (d) a top view; (e) a rear view; (f) a side view of a slanted portion and a pressing means; and (g) is a side view of a dislocation preventive member.
Figure 12E:
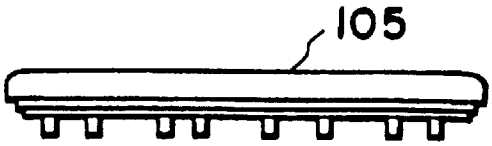
Figure 12B:
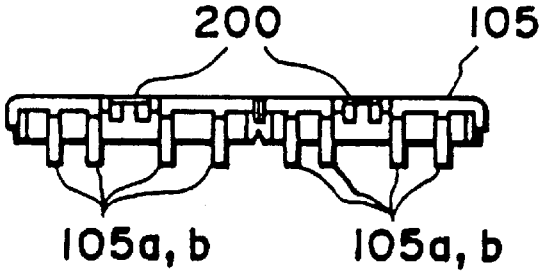
Figure 12F:
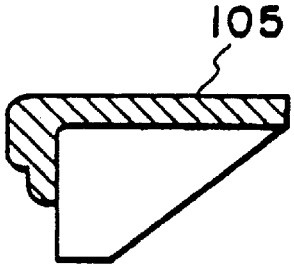
Figure 12C:
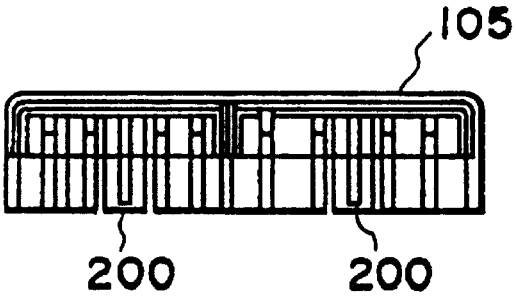
Figure 12G:
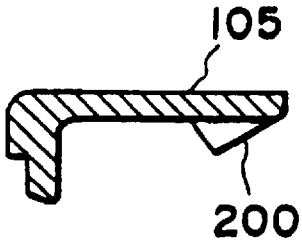
Figure 12D:
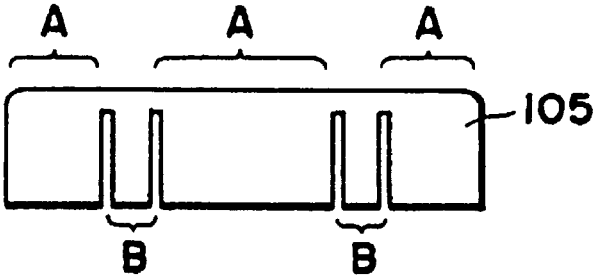

Referring to FIG. 11, it shows the relation displayed between the location of P5 and the insertion resistive force during the ink container inserting operation. In the states I–III, there is no insertion resistive force since there is no contact between P5 and the casing, as shown in the drawing, and then, in the state IV and thereafter, the resistance gradually increases.

Figure 8:
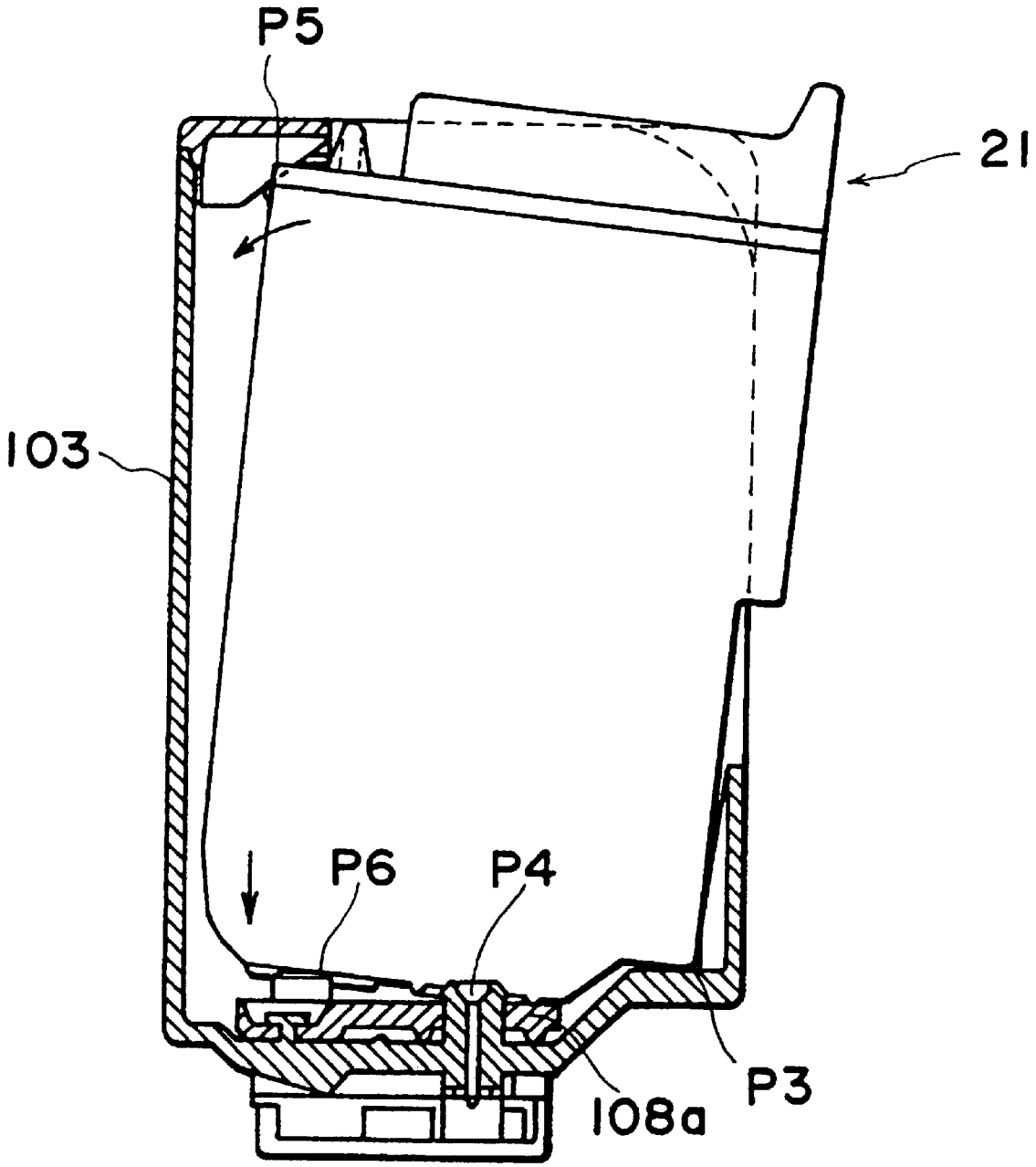
FIG. 8 is a schematic section that depicts the embodiment of the color ink container in accordance with the present invention, being in a stage V of the container installing process for installing the container into the ink jet unit.

FIG. 8 illustrates a state V in which the insertion has gone further, and in this state, the corner PS is at a location where the insertion resisting force is much larger than in the state IV, as FIG. 11(*b*) shows. At this time, the ink container is under a downward pressure effected by the configuration of the slanted portion of the camming shoe 105*a*.

Figure 9:
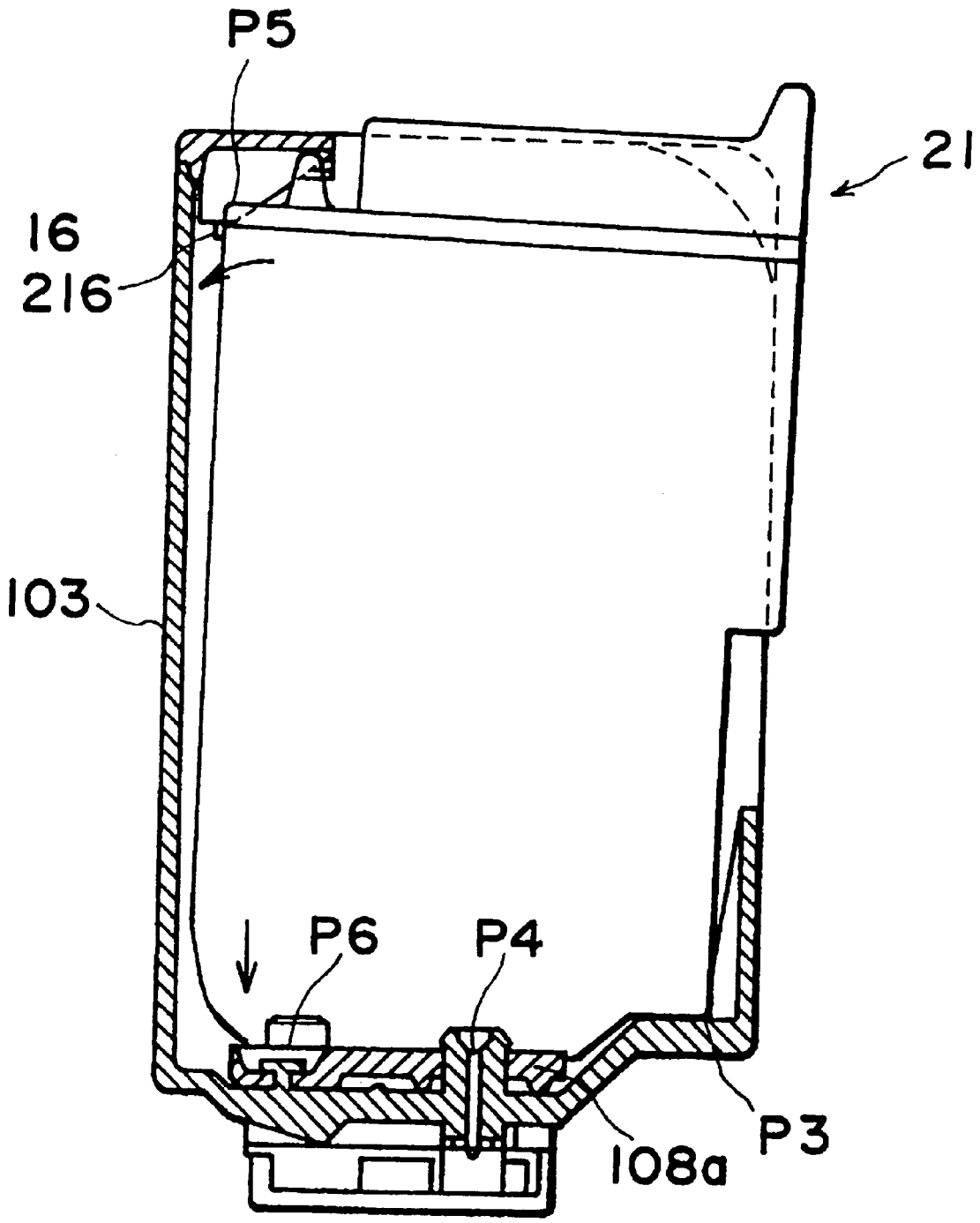
FIG. 9 is a schematic section that depicts the embodiment of the color ink container in accordance with the present invention, being in a stage VI of the container installing process for installing the container into the ink jet unit.

In a state IV illustrated in FIG. 9, the ink container corner P5 is near the end of its travel. At this time, the insertion resisting force is the highest as is evident from FIG. 11(*b*).

Figure 10:
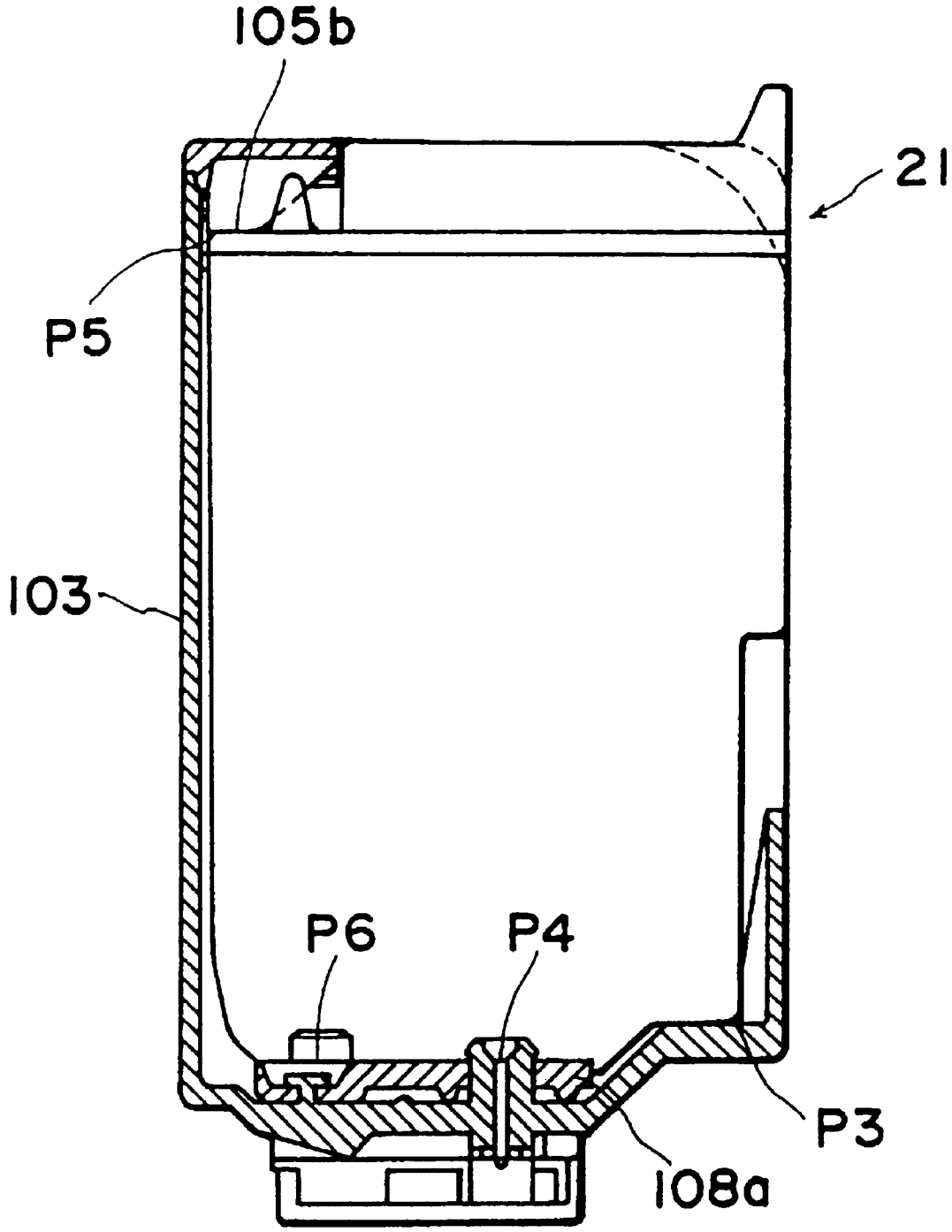
FIG. 10 is a schematic section that depicts the embodiment of the color ink container in accordance with the present invention, being in a stage VII of the container installing process for installing the container into the ink jet unit.

Then, as the ink container is further inserted, a state VII illustrated in FIG. 10 is realized, completing the insertion; in other words, the moment the ink container corner P5 finishes traveling on the slanted portion of the camming shoe 105*a*, it snappily engages with the pressing means 105*b*. Since the contact surface of the pressing means 105*b* is horizontal, the feel of resistance having been felt up to this point suddenly disappears at this moment, and this sudden disappearance of the resistance is felt by the user, with his hand, as a feel of the completion of a successful installation.

At this time, projections 16 and 216 provided on the ink container are snappily accelerated toward the internal wall of the casing as they are released, and when they collide with the wall, they generate a "clicking" sound, or a sure feel of clicking, which adds to the feel of the successful completion of the installation. Also at this time, the ink container is pressed downward by the horizontal portion of the pressing means, being surely locked in place.

Next, referring to FIG. 12, the dislocation preventive member 200 of the shoe portion will be described.

The top wall 105 is fused to the casing 103 with the use of ultrasonic waves, becoming integrated with the casing 103. FIG. 12 sequentially illustrates the conditions of the top wall portion 105 before it is welded, wherein (a, b, c, d, and e) are side view, front view, bottom view, top view, and rear view, respectively.

FIG. 12(*f*) illustrates the aforementioned slanted portion 105*a* and pressing means 105*g* of the top wall portion 105, and FIG. 12(*g*) illustrates the dislocation prevention member 200. The slanted portion of the camming shoe 105*a* and pressing means 105*b* illustrated in FIG. 12(*f*) are disposed at the bottom portion of an area A shown in FIG. 12(*d*), and the dislocation preventive member 200 illustrated in FIG. 12(*g*) is disposed in an area B shown in FIG. 12(*d*). In other words, the former two and the latter are independently disposed in different areas A and B. respectively.

When the ink container is further inserted from the state V (FIG. 8) to the state VII (FIG. 9), the projection 3 or 23, which is provided on the ink container on the downstream side relative to the inserting direction, comes in contact with the aforementioned dislocation preventive member 200 (FIG. 12(*g*)), at the tip of its arm portion, and while the ink container is rotatively inserted further, with its corner remaining in contact with the slanted portion, the projection 3 or 23 moves from the gently inclined portion to the steeply inclined portion, which is provided at the tip of the dislocation preventive member 200, and then, the ink container inserting operation ends at this point.

The arm portion is given the configuration described in the foregoing because of the following reasons: when the ink container is pulled out, the steeply inclined portion gives the user a feel of resistance, which is felt as a feel of assurance that the ink container has definitely come out; and this arm configuration prevents the ink container from being inadvertently dislocated.

These portions that fix the position of the ink container, and click when the ink container is inserted, and the member that prevents the dislocation of the ink container, and clicks when the ink container is removed, are separately disposed in different locations; therefore, the objects of the present invention can be accomplished with the use of an extremely small structure, in comparison with the prior structure in which these portions and members are disposed together.

The height of the front plate 113 from its bottom edge to the top edge 114 is approximately 22.0 mm. The front plate 113 contacts a part of the ink container when the ink container is installed, and a height higher than this height makes it difficult to install the ink container, whereas when the height of the front plate 113 is lower than this height, the ink front plate 113 cannot properly function as the ink container supporting member after the ink container is installed.

Figure 13:
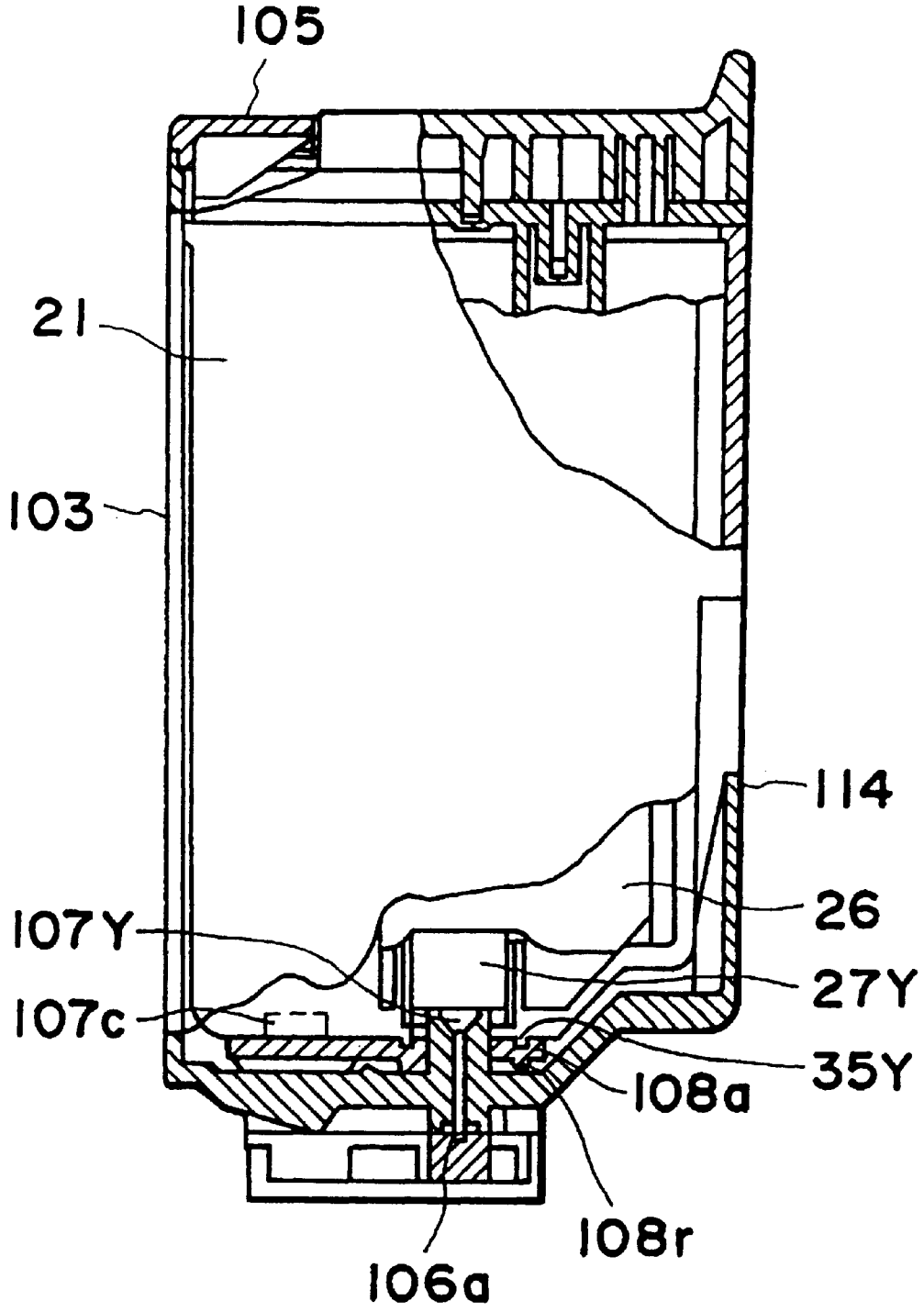
FIG. 13 is a partially cutaway side view of an ink jet unit in accordance with the present invention, depicting how the ink delivery port of the ink container and the ink delivery portion of the ink jet unit are connected.

Next, FIG. 13 illustrates how the ink delivery port of the ink container and the ink tapping portion of the ink jet unit are connected. FIG. 13 refers to a case in which the color ink container 21 is connected, and the same applies to a case in which the black ink container is connected.

Referring to FIG. 13, the ink tapping pipe 107Y of the ink jet unit 101 is inserted in the ink container 21 through the ink delivery port 28Y, being pressed upon the ink delivery member 27Y. The ink delivery member 27 comprises a bundle of fibers, so that it can efficiently deliver the ink within the ink absorbing material 26 of the ink container, only in one direction, that is, outward. When the ink tapping portion 107 comes in contact with the ink delivery member 27, high and low density regions are generated in the ink delivery member 27, promoting further the ink within the ink absorbing material to flow toward the ink tapping pipe. As a result, the ink delivery efficiency is improved. The ink tapping portions 107M and 107C are in contact with the ink delivery member 27 in the same manner.

Since the ink container is installed in the ink jet unit in such a manner as described hereinbefore, it can be simply and surely installed. Also, since it is installed through the rotary motion, the space required for the installation can be minimized, and its projection area can be reduced. As a result, the apparatus can be downsized without sacrificing the ink capacity.

The ribs provided on the ink container on the surrounding area of the ink delivery port are subjected to the pressure created by the camming shoe; being pressured onto the elastic member disposed on the bottom surface of the ink jet unit, and as it is pressured, it compresses the elastic member 103, preventing the ink from leaking therefrom. The elastic member 108 is provided with rib 108*r*. This rib 108*r* is located on the surface which comes in contact with the ink jet unit, and as it is compressed by the pressure from the ink container, it assures the airtight contact between the ink jet unit and elastic member 108. Next, the rib structure for improving the airtightness of the elastic member will be described.

Referring to FIG. 13, a reference numeral 108*a* designates an elastic member. A rib 108*r* is provided on elastic member 108*a*, on the side facing the casing 103, and seals the gap between the ink container 21 and casing 103. The ink container is provided with a container rib 35Y on the side facing the elastic member 108*a*. As the ink container 21 is installed into the ink jet head, the elastic member 108*a* is compressed against the ink container and is deformed. As it is deformed, the deformed portion is allowed to invade into the space formed (on both sides of the ribs) between the rib 108*r* and container rib 35Y. Therefore, the elastic member 108*a* can be easily compressed and the ink container can be smoothly installed or removed.

In this embodiment, the rubber thickness of the elastic member 108*a* is 1.0 mm at the flat portion, 1.4 mm at the rib portion, and the overall thickness is 2.4 mm. The height of the ink container rib is 0.6 mm. As for the material for the elastic member 108*a*, chlorinated butyl rubber having a rubber hardness of 40 is employed. However, silicone rubber, EPDM, or various other materials may be employed.

In this embodiment, the rib configuration is such that they are provided on the casing side of the elastic member, and also, on the ink container. Any rib configuration is acceptable as long as it offers a space into which the elastic member can be deformed. FIG. 14 illustrates such modifications, wherein in FIGS. 14(*b* and *c*), a rib 103*r* is provided on the casing side to permit deformation of the elastic member.

FIG. 15 is a transparent view showing the positional relation between the rib 108*r* of the elastic member 108*a* illustrated in FIG. 14 and the rib 35Y of the ink container, as seen from the ink container side.

The rib 108*r* of the elastic member is at a location corresponding to the ink container rib 35Y, and their central axes are deviated from each other less than 1.2 mm. This is the amount of deviation that can afford the airtightness. It is preferable for the amount of deviation to be 0.3 mm or less.

Figure 16:
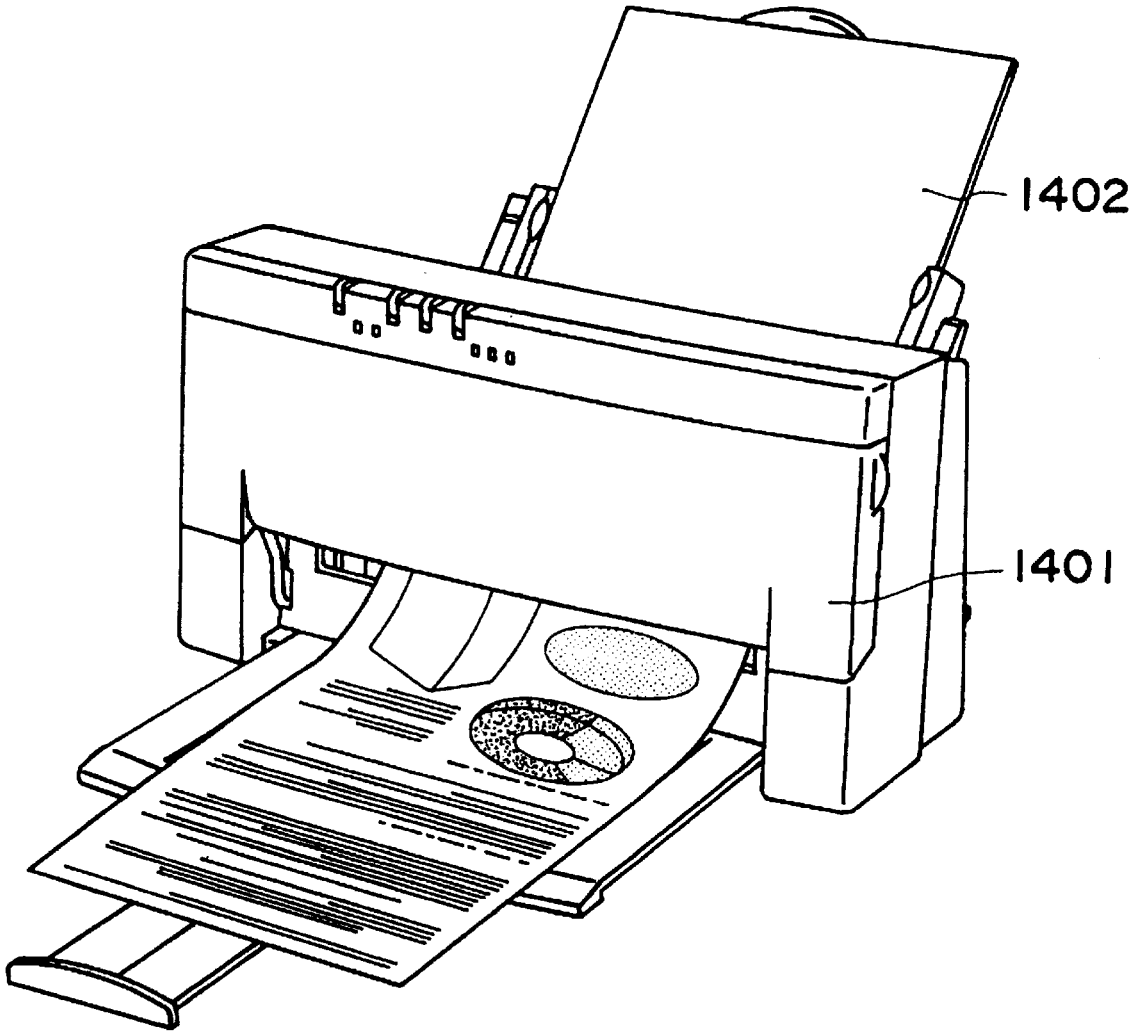
FIG. 16 is an oblique external view of a typical ink jet recording apparatus in accordance with the present invention.

FIG. 16 is a general oblique view of a typical ink jet recording apparatus usable with the ink jet unit in accordance with the present invention. This recording apparatus 1401 records images by ejecting the ink onto a piece of recording material 1402. FIGS. 17 and 18 illustrate how the ink container, which is a color ink container in this case, is exchanged, wherein a reference numeral 1501 designates an ink jet cartridge, 1502, a color ink tank; and 1503 designates a black ink tank.

FIG. 17 illustrates how the color ink tank is removed. First, the user hooks his finger on the tab of the ink container and pulls toward the front side, loosening it from the ink jet unit, as shown in FIG. 17(*a*). Then, the user can pull it out by pulling it upward, as shown in FIG. 17(*b*).

On the contrary, when the user wants to install it, he inserts the color ink tank 1502 into the ink jet cartridge 1501 from the diagonal direction, as shown in FIG. 18(*a*), and pushes it in, as shown in FIG. 18(*b*).

Figures 1, 19A:
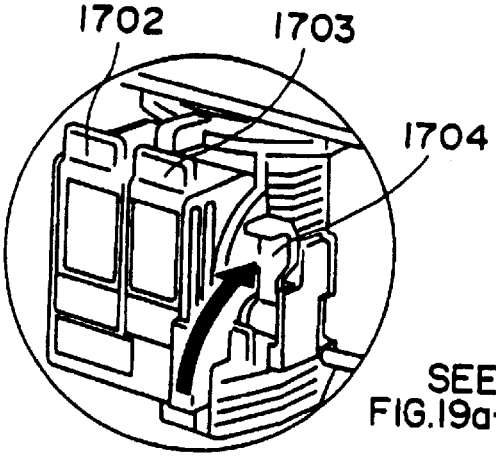
Figure 19A:
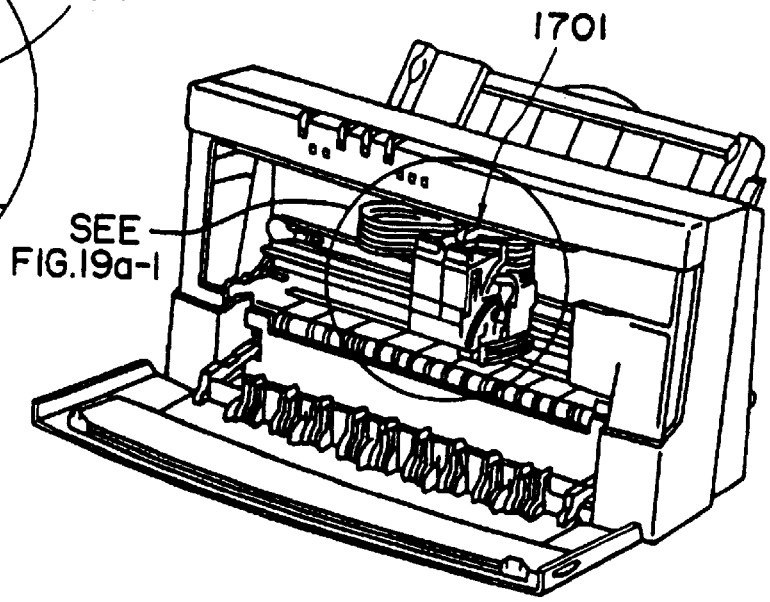
FIG. 19 illustrates how to remove a wholly exchangeable ink jet unit from an ink jet recording apparatus in accordance with the present invention, wherein (a) and (a-1) illustrate an operation to release a locking lever and (b) illustrates an operation to take out the ink jet unit.
Figure 19B:
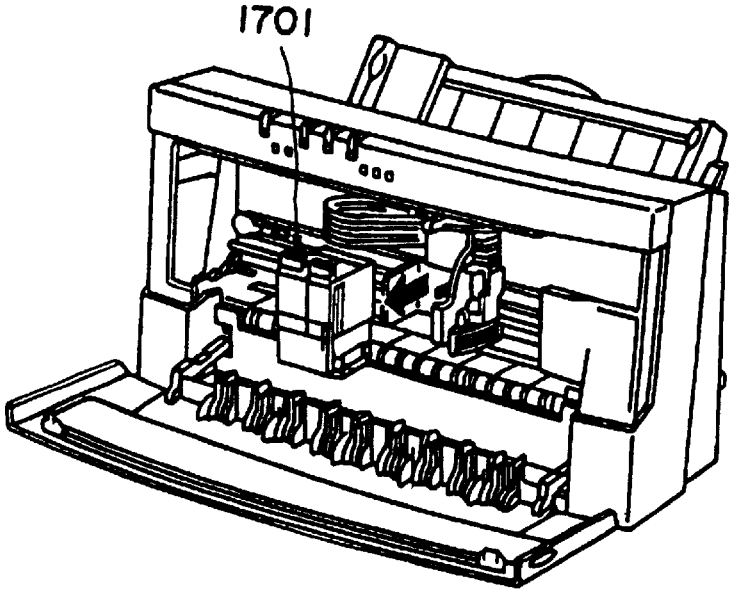

The ink jet unit to be installed into the ink jet recording apparatus in accordance with the present invention may be given a configuration such as the one shown in FIG. 19, in which, as a locking lever 1704 is released as shown in FIG. 19(*a*), the whole unit 1701 can removed for exchange, as shown in FIG. 19(*b*).

In this embodiment, when the ink container is inserted into, or pulled out of, the ink jet unit, it is rotated in the direction perpendicular to the carriage movement, using the bottom portion of the ink container accommodating portion of the casing as a guide. Therefore, the space that the ink jet unit occupies in the apparatus can be reduced. In particular, the space required for connecting the ink container to the recording head can be reduced; in other words, the projection area of the ink container relative to the bottom surface of the recording apparatus can be reduced.

Further, the ink container alone can be exchanged, leaving the ink jet unit on the main assembly of the carriage, which makes this exchanging method user friendly.

Further, there are provided in the casing, the guiding portion, which is shaped and disposed so as to guide rotatively the ink container into the ink container accommodating portion; and the shoe portion, which generates the feel of resistance when the ink container is inserted into the ink container accommodating portion; therefore, a proper amount of clicking feel can be given to the user.

Further, a member which divides the ink container accommodating portion into at least two separate areas is provided in the ink container accommodating portion; therefore, a combination of a plurality of exchangeable ink containers, typically, the combination of one black ink container and one color ink container, can be mounted on the same ink jet unit.

Further, the substantially T-shaped-partition wall is used to divide the internal space of the color ink container that supplies different inks to the color ink jet heads, for example, at least three types of ink can be stored in the container.

Further, the ink delivery ports, from each of which one of three color inks is delivered to the recording head, are disposed close to the point at which each ink storing portion is in contact with the other two ink storing portions; therefore, the space required for connecting the ink container to the recording head can be reduced.

Further, where the ink container is inserted into the ink container accommodating portion, it is put through the rotative movement about the guide portion of the casing, and the ink delivery port of the ink container is given the conical surface that tapers inward; therefore, the space required for inserting the ink container into the casing can be reduced.

Further, the ink storing portions are not arranged in parallel; therefore, the projection area of the ink container can be reduced.

Further, the ink container portion, which comes in contact with resistance generating portion of the shoe portion provided within the casing of the ink jet unit when the ink container is inserted into the ink container accommodating portion of the ink jet unit, is the ink container corner located on the side opposite to where the ink delivery port is located; therefore, the space required for inserting or removing the ink container is reduced.

Further, the ink container is given a stepped-up configuration on the upstream side relative to the inserting direction; therefore, the ink capacity is increased.

To sum up, according to the present invention, a plurality of ink containers are not, arranged in parallel on the ink jet unit; the basic color printing inks, that is, black, yellow, magenta, and cyan inks, can be stored in a space saving single unit, without reducing inadvertently the ink capacity; the user can easily install or remove the ink container, and can reliably confirm the completion of the successful installation; and the vertical space relative to the main assembly of the carriage can be efficiently utilized.

With the use of such a simple and inexpensive method as providing the ribs on the elastic member, the airtightness of the joint portion is improved and secured, and at the same time, the load inevitably imparted when the ink container is installed or removed can be reduced, preventing the ink from circumventing the junction.

The provision of the ribs on the surface, on which the ink delivery port is located, creates the gap for keeping the ink absorbing material away from the surface on which the ink delivery port is located; therefore, it is possible to provide an ink container in which the ink is prevented from concentrating to a certain portion of the ink absorbing material.

Since the ink concentration is eliminated, it is possible to provide an ink container capable of improving the ink delivery efficiency.

Further, it is possible to provide an ink container capable of preventing the ink from leaking out of the ink delivery port even when the ambient conditions vary.

While the invention has been described with reference to the structures disclosed herein, it is not confined to the details set forth and this application is intended to cover such modifications or changes as may come within the purposes of the improvements or the scope of the following claims.

What is claimed is:

1. An ink jet unit for detachably mounting an ink container and detachably mountable to an ink jet recording apparatus, said ink jet unit having a front side, a top side, a rear side, and a bottom side, defined by the orientation of said ink jet unit when it is mounted to said ink jet recording apparatus, and further comprising:

an ink jet head on one of said front side, said top side, said rear side, and said bottom side;

an inwardly projected ink receiving portion on an inner surface of said bottom side, for receiving ink from said ink container;

an opening formed in a part of the top side and a part of the front side, to permit mounting-and-demounting of said ink container relative to said ink jet unit;

a cover provided at least at a corner portion formed where the top side meets the rear side, said cover having urging means for urging said ink jet head; and a rib provided on an inner surface of the front side of said ink jet unit and having both a vertical surface and a slanted surface that is inclined relative to the vertical surface.

2. An ink jet unit according to claim 1, wherein said cover is provided with a retaining member and wherein said urging means comprises a portion of said retaining member.

3. An ink jet unit according to claim 1, further comprising a partition therein for defining two chambers, one of which is for a black ink container, and the other of which is for a color ink container containing yellow, cyan and magenta inks.

4. An ink jet unit according to claim 3, wherein the front side of the chamber for the black ink is partly cut away.

5. An ink jet unit according to claim 1, wherein an elastic member is provided around said ink receiving portion on an inner bottom surface of said ink jet unit.

6. An ink jet unit according to claim 1, wherein, when said ink container is inserted through the opening, an angle of inclination between a rear side of said ink container and the rear side of said ink jet unit is between 4 and 45 degrees inclusive.

7. A method of mounting an ink container to an ink jet unit mountable to an ink jet recording apparatus, wherein said ink container has a top side, a front side, a rear side, and a bottom side and said ink jet unit has a top side, a front side, a rear side, and a bottom side, defined by the orientation of said ink jet unit when it is mounted in said ink jet recording apparatus, and wherein said ink jet unit is provided with an ink jet head, an ink receiving portion provided on an inner bottom surface of the bottom side of said ink jet unit, for receiving ink from said ink container, an opening formed in a part of the top side and a part of the front side of said ink let unit, to permit mounting-and-demounting of said ink container relative to said ink jet unit, and a cover defined by at least a portion of the top side of said ink jet unit that is adjacent to a corner portion between the top side and the rear side of said ink jet unit, the cover having urging means for urging said ink container downwardly, said method comprising the steps of:

inserting said ink container through the opening in said ink let unit;

sliding a corner portion of said ink container that is between the top side and the rear side of said ink container into contact with said urging means; and at the same time, sliding a corner portion of said ink container that is between the front side and the bottom side of said ink container toward the front side of said ink jet unit in contact with the inner bottom surface of said ink jet unit.

8. A method according to claim 7, wherein a front inner surface of said ink jet unit has a rib having a vertical surface, and said rib is contacted to a front side of said ink container when said ink container is mounted thereto.

9. A method according to claim 7 or 8, wherein when said ink container has been mounted to said ink jet unit, the urging means urges downwardly said ink container so as to urge an ink supply port of said ink container to said ink receiving portion, and an inner rear side of said ink jet unit is contacted to a top portion of a rear side of said ink container, and a rib of said ink jet unit is contacted to a bottom portion of a front side of said ink container so as to correctly position said ink container relative to said ink jet unit.

10. A method according to claim 7, wherein said ink container is mounted inclinedly to said ink jet unit, and then is rotated to correctly position it, and wherein in the inclined state, an angle of the inclination is between 5 and 45 decrees inclusive.

11. A method according to claim 7, wherein said ink container is provided with an ink supply port for fluid communication with said ink receiving portion, and said ink supply port has an inside opening portion and an outside opening portion having a circumferential length larger than that of the inside opening portion, and said inside opening portion and said outside opening portion are connected by inclined surface.

12. An ink container mountable to an ink jet unit which has a front side, a top side, a rear side, a left side, a right side, and a bottom side, as defined by the orientation of said ink jet unit when mounted in an ink jet recording apparatus, an ink jet head, an ink receiving portion, projected upwardly from an inner surface of the bottom side, for receiving ink from said ink container, an opening formed over a part of the top side and a part of the front side, to permit mounting-and-demounting of said ink container relative to said ink jet unit, a cover defined by at least a portion of the top side of said ink jet unit that is adjacent to a corner portion between the top side and the rear side of said ink jet unit and a rib provided on a front inner surface of the front side of said ink jet unit and having a vertical surface, said ink container having a front side, a top side, a rear side, a left side, a right side, and a bottom side, as defined by the orientation of said ink container when mounted in the ink jet unit, and further comprising:

an air vent in one of the front side, the top side, the bottom side, the left side, the right side, and the rear side, for fluid communication between an inside of said ink container and ambience;

an ink supply port for receiving the ink receiving portion in fluid communication with the ink jet head; and wherein said ink supply port is formed in the bottom side of said ink container at a position nearer to the rear side of said ink container than to the front side of said ink container, and wherein, when said ink container is mounted in said ink jet unit, the front side of said ink container is in contact with the vertical surface of said rib of said ink jet unit.

13. An ink container according to claim 12, further comprising a projection, on a rear side of said ink container, for contacting to a rear side of said ink jet unit.

14. An ink container according to claim 12, wherein said ink jet unit is provided with an ink jet unit retaining member, and said ink container is provided with a projection engageable with said retaining member.

15. An ink container according to claim 12, wherein said ink jet unit is provided with a partition for defining two chambers therein, one of which is for a single color ink container and is provided with a cut-away portion, said ink container has a projection engageable with said cut-away portion.

16. An ink container according to claim 12, wherein said ink supply port has an inside opening portion and an outside opening portion having a circumferential length larger than that of the inside opening portion, and said inside opening portion and said outside opening portion are connected by an inclined surface.

17. An ink container according to claim 12, wherein said ink container further comprises a portion disposed on the top side of said ink container for facilitating mounting or demounting of said ink container.

18. An ink container according to claim 12, wherein said ink container is partitioned for containing yellow, cyan and magenta inks separately therein, and ink supply ports are formed in a bottom side of the ink container at a position deviated toward a rear side when it is in use.

19. An ink container according to claim 12, wherein said ink container has a total height and an inner volume, and said ink container is stepwisely expanded at a position of one half the total height thereof to expand the inner volume.

20. An ink container according to claim 12, wherein at least a portion of the rear side of said ink container that is adjacent the bottom side of said ink container is inclined outwardly.

21. An ink container according to claim 12, further comprising an ink absorbing material for retaining the ink therein.

22. An ink container according to claim 12, further comprising an ink absorbing material for retaining the ink disposed between the front side, top side, rear side and bottom side, and a fibrous material at said ink supply port.

23. An ink container mountable to an ink jet unit which has a front side, a top side, a rear side, a left side, a right side, and a bottom side, as defined by the orientation of said ink jet unit when mounted in an ink jet recording apparatus, an ink jet head, an ink receiving portion, projected upwardly from an inner surface of the bottom side for receiving ink from said ink container, an opening formed in a part of the top side and a part of the front side, to permit mounting-and-demounting of said ink container relative to said ink jet unit, a cover defined by at least a portion of the top side of said ink jet unit that is adjacent to a corner portion between the top side and the rear side of said ink jet unit, and a rib provided on a front inner surface of the front side of said ink jet unit and having a vertical surface, said ink container having a front side, a top side, a rear side, a left side, a right side, and a bottom side, as defined by the orientation of said ink container when mounted in the ink jet unit, and further comprising:

an air vent in one of the front side, the top side, the bottom side, the left side, the right side, and the rear side, for fluid communication between an inside of said ink container and ambience;

an ink supply port formed in the bottom side of said ink container, for receiving the ink receiving portion in fluid communication with the ink jet head;

a top side engaging portion, provided on the top side of said ink container adjacent the rear side of said ink container, for contacting the cover of said ink jet unit;

a picking portion for facilitating mounting and demounting of said ink container relative to said ink jet unit; and a bottom side engaging portion, adjacent the front side of said ink container, for slidingly contacting an inner bottom surface of the bottom side of said ink jet unit;

wherein at least a portion of the rear side of said ink container that is adjacent the bottom side of said ink container is inclined outwardly.

24. An ink container according to claim 23, further comprising a projection, on a rear side of said ink container, for contacting to a rear side of said ink jet unit.

25. An ink container according to claim 23, wherein said ink supply port is formed in the bottom side of said ink container at a position that is nearer to the rear side of said ink container than to the front side of said ink container.

* * * * *

UNITED STATES PATENT AND TRADEMARK OFFICE

CERTIFICATE OF CORRECTION

PATENT NO. : 6,145,975
DATED : November 14, 2000
INVENTOR(S) : Yasuo Kotaki, et al.

It is certified that error appears in the above-identified patent and that said Letters Patent is hereby corrected as shown below:

Title page,
Item [56] References Cited,
U.S PATENT DOCUMENTS, "37619 7/1990 European Pat. Off..." should be deleted.

FOREIGN PATENT DOCUMENTS "0622208 4/1994 European Pat. Off.." should be deleted.

"2039945 2/1990 Japan." should read
-- 2-39945 2/1990 Japan. --.

Insert -- 376719 7/1990 European Pat. Off." --.

Column 1,
Line 10, "ink" should read -- ink tank or --.

Column 6,
Line 7, "unit" shoud read -- unit or cartridge --.
Line 11, "plates," should read -- plates or walls, --.
Line 12, "or walls" should be deleted.
Line 49, "of; and" should read -- of --.
Line 61, "in" should read -- ink --.

Column 7,
Line 10, "the" should read -- and --.

Column 8,
Line 15, "penetrate," should read -- penetrates, --.

Column 9,
Line 46, "is" should read -- are --.
Line 61, "erecting" should read -- extending --.

Column 10,
Line 63, "height" should read -- height of --.

Column 12,
Line 23, "105a;" should read -- 105a --.
Line 38, "slated" should read -- slanted --.

UNITED STATES PATENT AND TRADEMARK OFFICE

CERTIFICATE OF CORRECTION

PATENT NO. : 6,145,975
DATED : November 14, 2000
INVENTOR(S) : Yasuo Kotaki, et al.

It is certified that error appears in the above-identified patent and that said Letters Patent is hereby corrected as shown below:

Column 13,
Line 49, "and" should be deleted.

Column 15,
Line 7, "camming" should be deleted.
Line 8, "on the" should read -- on the camming --.

Column 16,
Line 57, "shoe;" should read -- shoe, --.

Column 18,
Line 52, "not," should read -- not --.

Column 20,
Line 1, "let" should read -- jet --.
Line 8, "let" should read -- jet --.
Line 41, "by" should read -- by an --.

Column 21,
Line 18, "said" should read -- and said --.
Line 35, should read -- that is nearer to the rear side of said ink container than to the front side of said ink container --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*